US010851595B2

(12) United States Patent
Donnally et al.

(10) Patent No.: US 10,851,595 B2
(45) Date of Patent: Dec. 1, 2020

(54) SHIPPING ARRANGEMENT AND ASSEMBLY PROCEDURE FOR DRILLING RIG STRUCTURES

(71) Applicant: National Oilwell Varco, L.P., Houston, TX (US)

(72) Inventors: Robert Benjamin Donnally, Plano, TX (US); Colin Guo, Shanghai (CN)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 16/019,126

(22) Filed: Jun. 26, 2018

(65) Prior Publication Data

US 2019/0368279 A1 Dec. 5, 2019

Related U.S. Application Data

(60) Provisional application No. 62/677,490, filed on May 29, 2018.

(51) Int. Cl.
*E21B 15/00* (2006.01)
*E04H 12/34* (2006.01)

(52) U.S. Cl.
CPC ..... *E21B 15/00* (2013.01); *E04H 12/345* (2013.01)

(58) Field of Classification Search
CPC ..... E21B 15/00; E21B 15/003; E21B 7/023; E21B 7/02; E04B 1/3522; E04H 12/345
See application file for complete search history.

(56) References Cited

U.S. PATENT DOCUMENTS

| | | | | |
|---|---|---|---|---|
| 4,341,270 | A * | 7/1982 | Ferguson | E21B 19/08 173/151 |
| 4,932,175 | A * | 6/1990 | Donnally | E21B 7/023 52/118 |
| 8,468,753 | B2 * | 6/2013 | Donnally | E21B 7/02 173/186 |
| 8,720,128 | B2 | 5/2014 | Vogt | |
| 9,091,126 | B2 * | 7/2015 | Thiessen | E21B 15/00 |
| 9,168,799 | B2 * | 10/2015 | Ellis | B60P 3/2215 |
| 9,359,784 | B2 * | 6/2016 | Trevithick | E21B 15/00 |
| 9,988,807 | B2 * | 6/2018 | Konduc | E04B 1/3522 |
| 2011/0072737 | A1 * | 3/2011 | Wasterval | E21B 7/021 52/115 |

* cited by examiner

*Primary Examiner* — Brian D Mattei
*Assistant Examiner* — Daniel J Kenny
(74) *Attorney, Agent, or Firm* — Schwegman Lundberg & Woessner, P.A.

(57) ABSTRACT

A center drill floor assembly of a drilling rig structure includes a center floor structure and a drilling rig mast section that is at least partially nested within the center floor structure, wherein the center drill floor assembly is adapted to be transported to a drilling site as a single modular assembly and removably attached as a single modular assembly to a drilling rig substructure during assembly of the drilling rig structure.

23 Claims, 23 Drawing Sheets

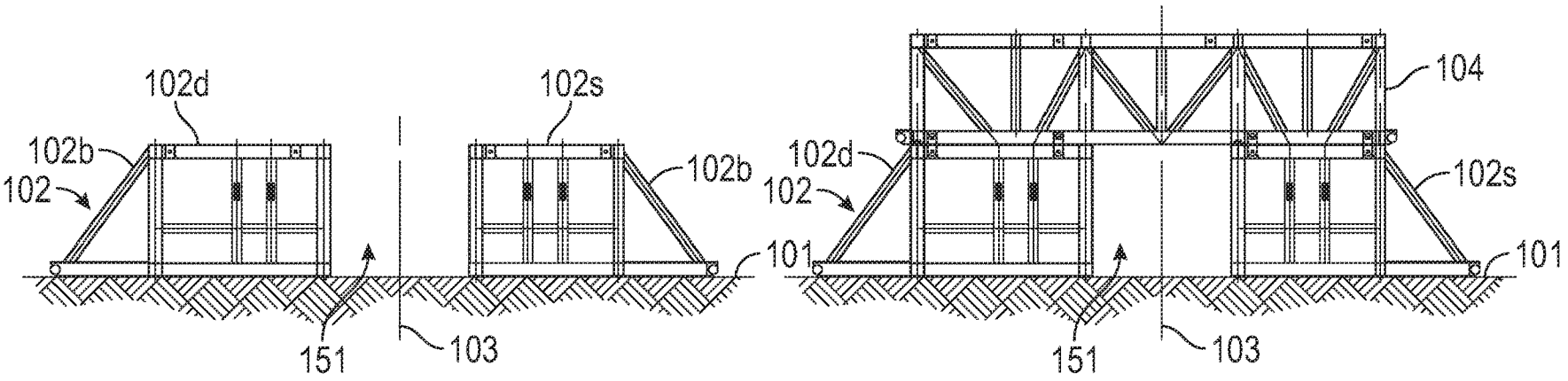
FIG. 6A
FIG. 6B
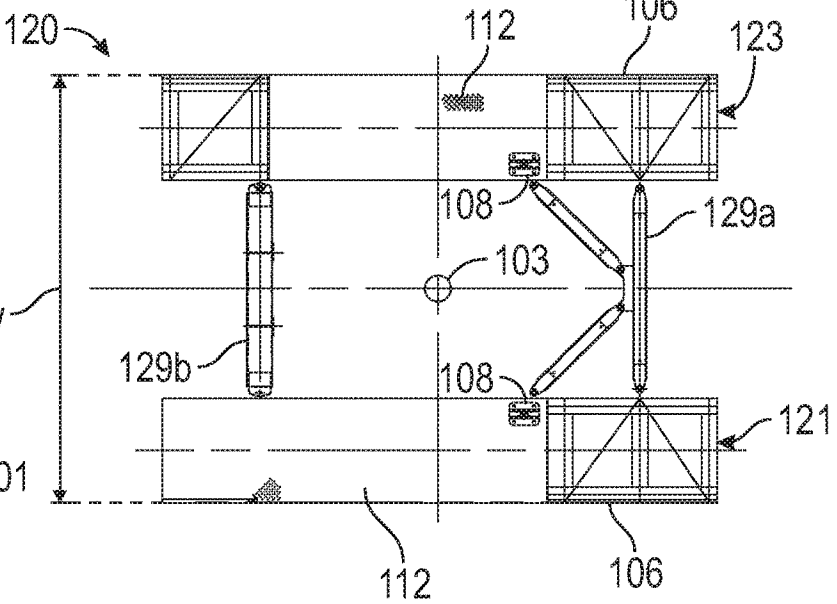
FIG. 6D
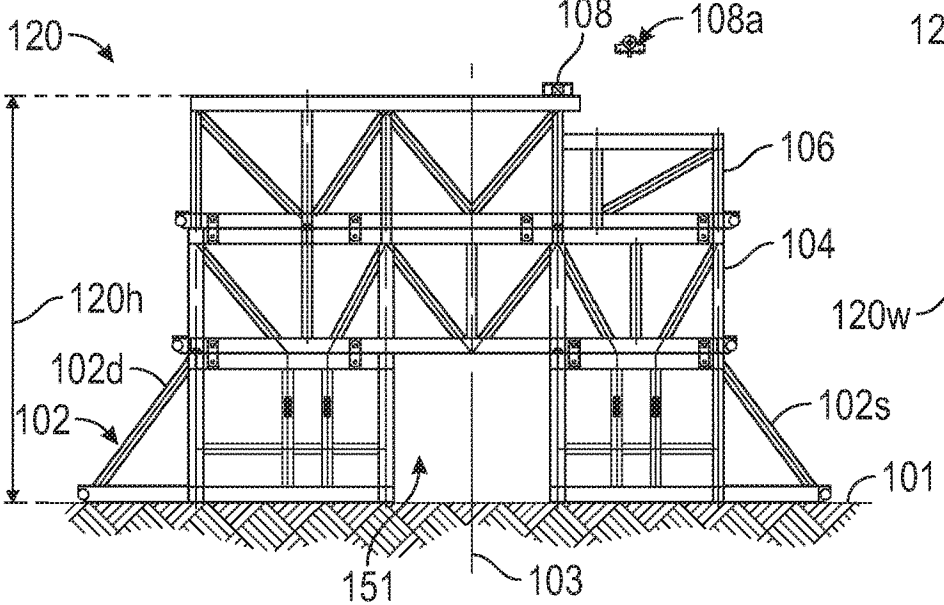
FIG. 6C

SHIPPING ARRANGEMENT AND ASSEMBLY PROCEDURE FOR DRILLING RIG STRUCTURES

BACKGROUND

1. Field of the Disclosure

The present subject matter is generally directed to drilling rig structures, and in particular to improved assemblies and arrangements for shipping the components and assemblies of a drilling rig structure to a drilling site, and methods for assembling the drilling rig structure at the drilling site.

2. Description of the Related Art

In many land-based oil and gas drilling operations, drilling rigs are delivered to an oilfield drilling site by transporting the various components of the drilling rig over roads and/or highways. Typically, the various components of the drilling rig structure are transported to a drilling site on one or more truck/trailer combinations, the number of which may depend on the size, weight, and complexity of the rig, as well as the limitations and restrictions on size and weight of a particular shipment along a given roadway. Once at the drilling site, the components of the drilling rig structure are then assembled, and the drilling rig mast is raised to an operating position so as to perform drilling operations. After the completion of drilling operations, the drilling rig structure is disassembled, loaded back onto truck/trailer combinations, and transported to a different oilfield drilling site for new drilling operations, or to a permanent or temporary storage area. Accordingly, the ease with which the various components of the drilling rig structure can be transported, assembled and disassembled, and the drilling rig mast raised and lowered, can be a substantial factor in the drilling rig design, as well as the rig's overall operational capabilities and cost effectiveness.

Some prior art drilling rig structures are designed so that they can be assembled and erected without relying on the use of a dedicated crane to lift and position the various rig structure components during assembly. For example, U.S. Pat. No. 8,468,753, discloses a drilling rig structure wherein the drilling rig substructure can be collapsed or folded down into a compact configuration for transportation to a drilling site, such that upper boxes of the substructure are folded down and positioned in close proximity to lower boxes of the substructure by operation of a plurality of pivotable support members and cylinder apparatuses. After arriving at the drilling site, the substructure boxes are positioned adjacent to the wellbore location, the rig drawworks is coupled to the upper boxes of the substructure, the drilling rig mast sections are assembled and pivotably coupled to the upper boxes, the assembled mast is pivotably erected above the collapsed/folded substructure to it its vertical operating (drilling) position. Once the mast has been fully erected, the upper substructure boxes are then raised above the lower substructure boxes until the drill floor on the upper boxes is at the appropriate operating height above the ground. In order to be able to perform all of these assembly and raising/erection steps without using a crane, the height of the substructure in its collapsed/folded configuration is typically in the range of approximately 5 ft to 8 ft (1.5 m to 2.5 m) so that all of the necessary assembly operations can be performed at convenient heights of about 8 ft to 12 ft (2.5 m to 3.5 m) above the ground.

Due to certain drilling site considerations, such as environmental loads and the like, the design of some prior art drilling rig structures may not allow the use of collapsible/foldable configurations described above, but instead may require that the various components of the rig structure be assembled using a crane (or cranes) to lift and position the components during assembly and erection activities. One such rig structure configuration, sometimes referred to as a "box-on-box" substructure configuration, is illustrated in FIGS. 1A-1L and described below.

FIGS. 1A-1C are side elevation views and FIG. 1D is a plan view of a drilling rig structure 50 during the early stages of assembly of the drilling rig substructure 20. As shown in FIGS. 1A and 1D, two lower/base substructure boxes 2 are positioned on the ground 1 (or on a drilling mat covering the ground 1) such that the two base substructure boxes 2 are laterally spaced apart and straddle the vertical centerline of a wellbore 3 that will eventually be drilled using the drilling rig structure 50. Next, an intermediate substructure box 4 is positioned on top of and attached to each of the base substructure boxes 2, after which an upper substructure box 6 is then positioned on top of and attached to each intermediate substructure box 4. These assembly steps thereby create two stacked substructure box assemblies 21 and 23—i.e., "box-on-box" configurations—that are laterally spaced apart and straddle the wellbore centerline 3, which form the base structural framework of the substructure 20. For some "box-on-box" substructure configurations, the overall height 20*h* of each stacked substructure box assembly 21 and 23 can range from approximately 18 ft to 35 ft (5.5 m to 10.7 m) or greater, depending on the particular rig design and application.

Typically, the upper substructure boxes 6 will include front and rear mast support shoes 8 and 10, which are the main structural connectors that are used to removably couple the drilling rig mast 40 (see FIGS. 1H-1L) to the substructure 20 so that the dead load of the mast 40 and any dynamic loads generated during drilling operations and/or caused by environmental conditions are transferred to the substructure 20 and down to the ground.

After the two stacked substructure box assemblies 21 and 23 have been completed, a center floor section 7 is positioned on and attached to the two upper substructure boxes 6, such that the center floor section 7 spans the lateral space between the two stacked supports 21 and 23. For the "box-on-box" drilling rig structure, the center floor section 7 will often include the rotary table 9, the drill floor 12, and the setback area 11 that is used to support stands of drill pipe (not shown) during drilling operations.

FIGS. 1F and 1G are plan and elevation views, respectively, of the drilling rig structure 50 after a drawworks has been assembled and installed on the center floor section 7 and above the upper substructures boxes 6, and after a local equipment or tool room house 18 has been assembled and installed above the upper substructures boxes 6. Structural connectors 8*a* and 10*a* have also been mounted on the front and rear mast support shoes 8 and 10, respectively, and a structural frame 16—often referred to as an "A-frame"—has been attached to the connectors 8*a*, 10*a*. As noted previously, the overall height 20*h* of the substructure 20 (see, FIG. 1C) would typically require that a crane be used to lift and position each of these rig components into place above the upper substructure boxes 6. Additionally, a mast stand 22 has been positioned adjacent to the setback side of the substructure 20 in anticipation of mounting, assembling, and erecting the drilling rig mast 40 (not shown in FIGS. 1F and 1G; see, FIGS. 1H-1L, described below).

FIGS. 1H-1J are elevation views of the drilling rig structure 50 during certain stages of mounting and assembling the drilling rig mast 40. As shown in FIG. 1H, a bottom mast section 26 of the drilling rig mast 40 has been lifted into position above the upper substructure box 6, and the lower end of the bottom mast section 26 (shown as being oriented to the right in FIG. 1H) has been coupled to the connector 8*a*, which also supports the front leg of the A-frame 16. The bottom mast section 26 is positioned in a horizontal orientation such that the upper end of the bottom mast section 26 (show as being oriented to left in FIG. 1H and away from the connector 8*a*) is supported by the mast stand 22. Additionally, mast erection cylinders 24—which will eventually be used to raise the drilling rig mast 40 into the substantially vertical operating position—have been coupled at their lower ends to pinned connections 4*a* on the two intermediate substructure boxes 4, and pivotably coupled at their upper ends to pinned connections 26*b* on the bottom mast section 26. FIG. 1I shows the mast assembly process after the lower end of a horizontally oriented first intermediate mast section 28 has been connected to the upper end of the bottom mast section 26, and FIG. 1J depicts the drilling rig structure 50 after the drilling rig mast 40 has been fully assembled and dressed out. In particular, FIG. 1J shows that a second intermediate mast section 30 has been connected to the upper end of the first intermediate mast section 28, a top mast section 32 has been connected to the upper end of the second intermediate mast section 30, and a crown block assembly 34 has been connected to the upper end of the top mast section 32. Additionally, the racking board 36 has been mounted on the setback side of the drilling rig mast 40, the traveling hook 38 has been mounted in the mast 40, and access ladders 35 and platforms 37 have been mounted on the mast 40.

FIG. 1K is an elevation view of the drilling rig structure 50 as the drilling rig mast 40 is being raised/erected above the substructure 20. As shown in FIG. 1K, actuation of the mast erection cylinders 24 causes the mast erection cylinders 24 to telescopically extend, and this in turn causes the drilling rig mast 40 to pivot about the connector 8*a* on the front mast support shoe 8 to which the lower end of the bottom mast section 26 is coupled. FIG. 1L is an elevation view of the drilling rig structure 50 after the drilling rig mast 40 has been fully erected to its vertical operating orientation, the drilling line 39 has been connected to the drawworks 14, and the upper ends of the mast erection cylinders 24 have been detached from their respective pinned connections 24*b* on the setback side of the bottom mast section 26. Also as shown in FIG. 1L, the drilling rig mast 40 is held upright in its substantially vertical operating orientation by attaching the lugs 26*a* positioned on the drawworks side of the bottom mast section 26 to corresponding connector plates 16*a* on the A-frame 16.

As mentioned previously, the overall height 20*h* of some "box-on-box" substructure configurations can be 35 ft (10.7 m) or even greater, which therefore requires a crane to be used during many stages of the drilling rig structure assembly process. For example, due to the stacked configuration of the "box-on-box" substructure design that is typical of prior art rigs as shown in FIGS. 1A-1L, the intermediate substructure boxes 4 typically have to be lifted and positioned on the base substructure boxes 2 using a crane, as would also be the case for positioning the upper substructure boxes 6 on the intermediate substructure boxes 4 and the center floor section 7 on the upper substructure boxes 6. Additionally, once the substructure box assemblies 21 and 23 are completed and the center floor section 7 positioned thereon, a crane would also be required to lift the bottom mast section 26 and position it for attachment to the connector 8*a*, due to the substructure height 20*h*. Similarly, a crane would also be necessary to lift each of the intermediate mast sections 28, 30, the top mast section 32, and the crown block assembly 34 so as to position each for sequential attachment to the preceding mast section.

Generally, each of the major components of the drilling rig structure 50—such as the substructure boxes 2, 4, and 6, the center floor section 7, the drawworks 14, the A-frame 16, the local equipment room house 18, and the various drilling rig mast components 26, 28, 30, 32, 34, and 26—are packed and shipped to and from a drilling rig site on separate individual truck/trailer loads. As such, each of these components are typically separately and individually positioned in place using a crane (or cranes) to lift, move, and/or hold the components while they are being positioned on and/or fitted up to an adjacent mating component. Furthermore, using cranes to perform these various individual lifting, moving, and positioning operations can be cumbersome and time-consuming operations since some drilling rig assembly activities cannot be performed in parallel with other activities. As such, the use of cranes to separately lift, move, and position individual rig components can often dictate the critical path for the overall assembly and erection of the drilling rig structure.

Accordingly, there is a need to develop new and unique shipping arrangements for the various components of a drilling rig structure so as to facilitate a simpler and less time-consuming approach to assembling and disassembling the rig structure when using cranes. The following disclosure is directed to various systems, arrangements, and methods that are intended address, or at least minimize, some of the above-described shortcomings of the existing shipping arrangements that are used for the typical prior art "box-on-box" type drilling rig structures and the methods that are used to assemble and disassemble them.

SUMMARY OF THE DISCLOSURE

The following presents a simplified summary of the disclosure in order to provide a basic understanding of some aspects of the subject matter that is described in further detail below. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein is directed to improved assemblies and arrangements for shipping the components and systems of drilling rig structure to a drilling site and methods for assembling the drilling rig structure at the drilling site. One illustrative embodiment of the present disclosure is a center drill floor assembly of a drilling rig structure that includes a center floor structure and a drilling rig mast section that is at least partially nested within the center floor structure, wherein the center drill floor assembly is adapted to be transported to a drilling site as a single modular assembly and removably attached as a single modular assembly to a drilling rig substructure during assembly of the drilling rig structure.

Yet another illustrative embodiment disclosed herein is a drilling rig structure that includes a substructure having two spaced-apart substructure box assemblies and a center drill floor assembly that includes a center floor structure, a mast support shoe mounted on the center floor structure, and a bottom drilling rig mast section that is pivotably coupled to the mast support shoe. The center drill floor assembly is adapted to be transported to a drilling site as a single modular assembly and removably attached as a single modular assembly to the two spaced-apart substructure box assemblies during assembly of the drilling rig structure.

In another exemplary embodiment, a method of assembling a drilling rig structure includes, among other things, assembling a center drill floor assembly that includes a center floor structure and a bottom drilling rig mast section and transporting the assembled center drill floor assembly to a drilling site as a single modular assembly. The disclosed method further includes positioning first and second substructure box assemblies of a drilling rig substructure adjacent to a wellbore location at the drilling site such that the first and second substructure box assemblies are spaced apart and straddling the wellbore location, and removably attaching the center drill floor assembly as a single modular assembly to the first and second spaced-apart substructure box assemblies. Additionally, the method includes, after removably attaching the center drill floor assembly to the first and second spaced-apart substructure box assemblies, removably attaching at least one additional drilling rig mast section to the bottom drilling rig mast section so as to assemble a drilling rig mast assembly, and raising the assembled drilling rig mast assembly to an operating orientation above the drilling rig substructure.

BRIEF DESCRIPTION OF THE DRAWINGS

The disclosure may be understood by reference to the following description taken in conjunction with the accompanying drawings, in which like reference numerals identify like elements, and in which.

Figure 1A:
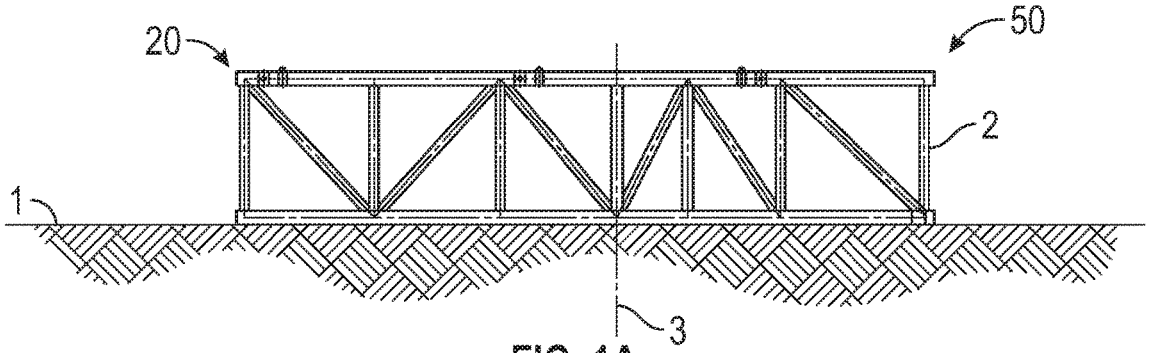
FIG. 1A (Prior Art)
FIGS. 1A-1L depict various views of a drilling rig structure having a "box-on-box" substructure configuration during the assembly and erection process of the rig.
Figure 1B:
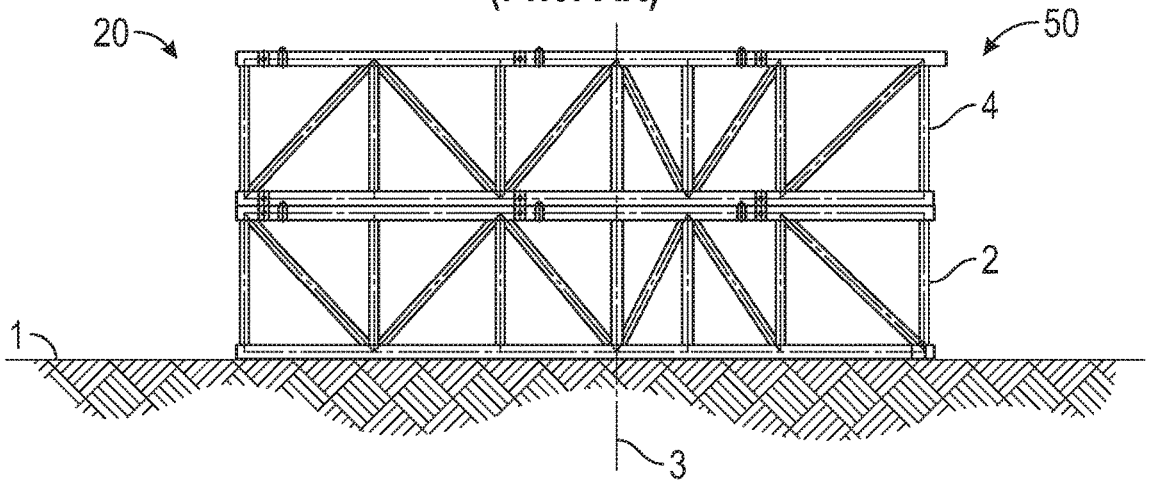
FIG. 1B (Prior Art)
Figure 1C:
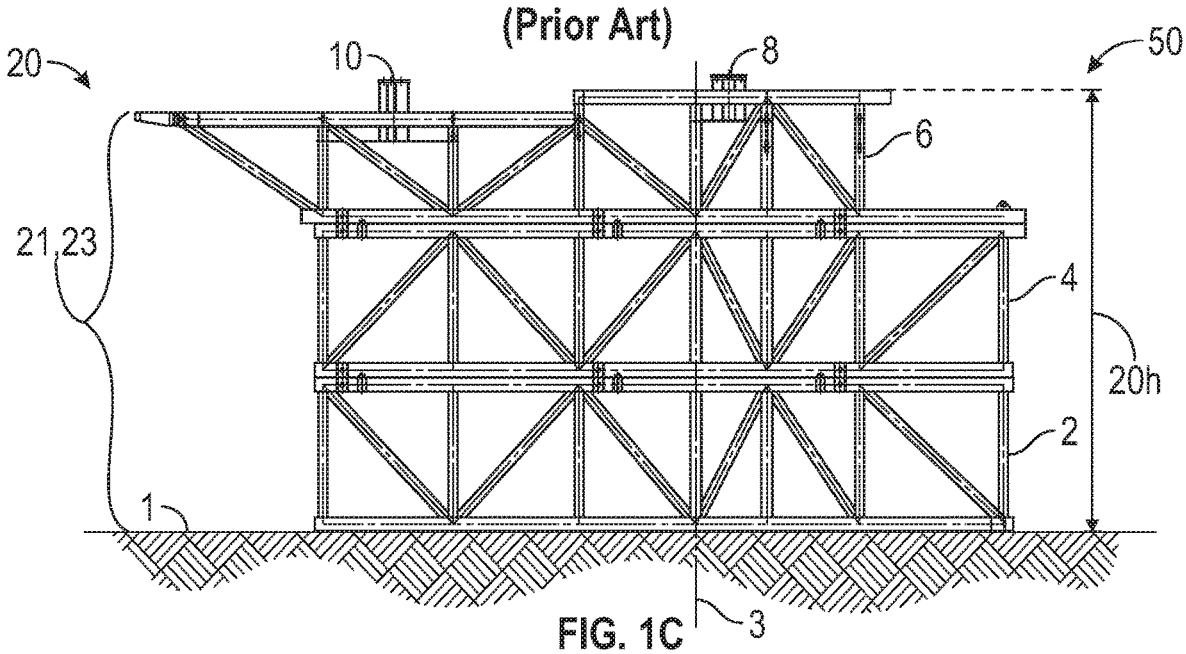
FIG. 1C (Prior Art)
Figure 1D:
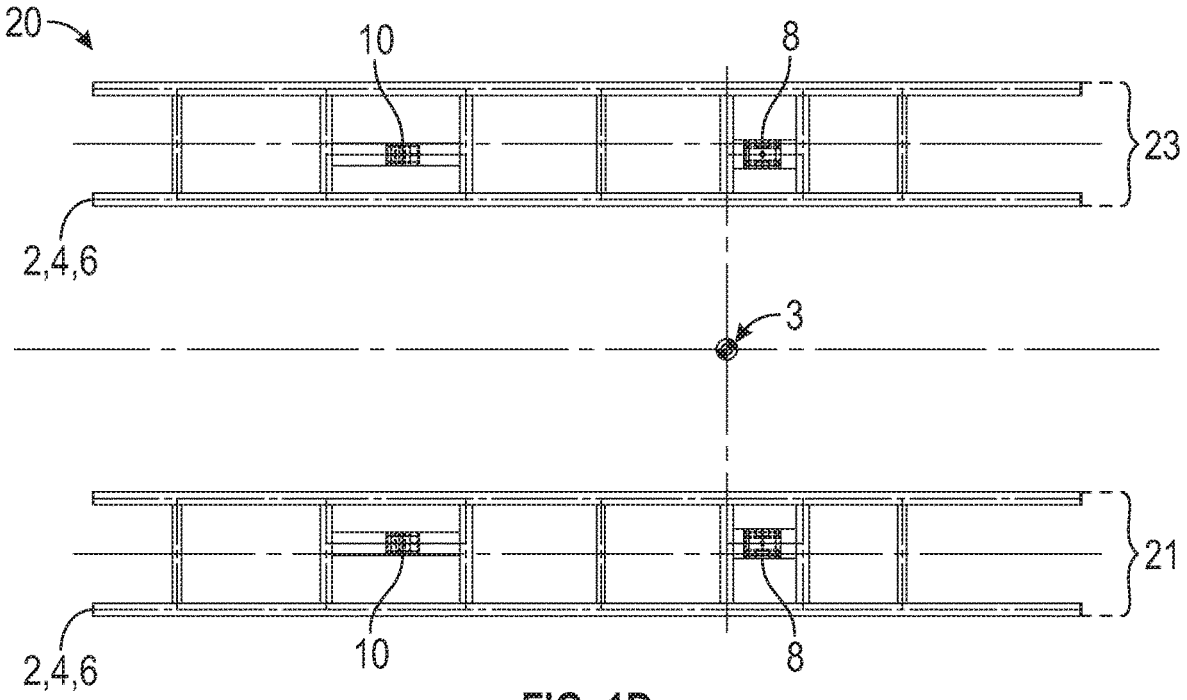
FIG. 1D (Prior Art)
Figure 1E:
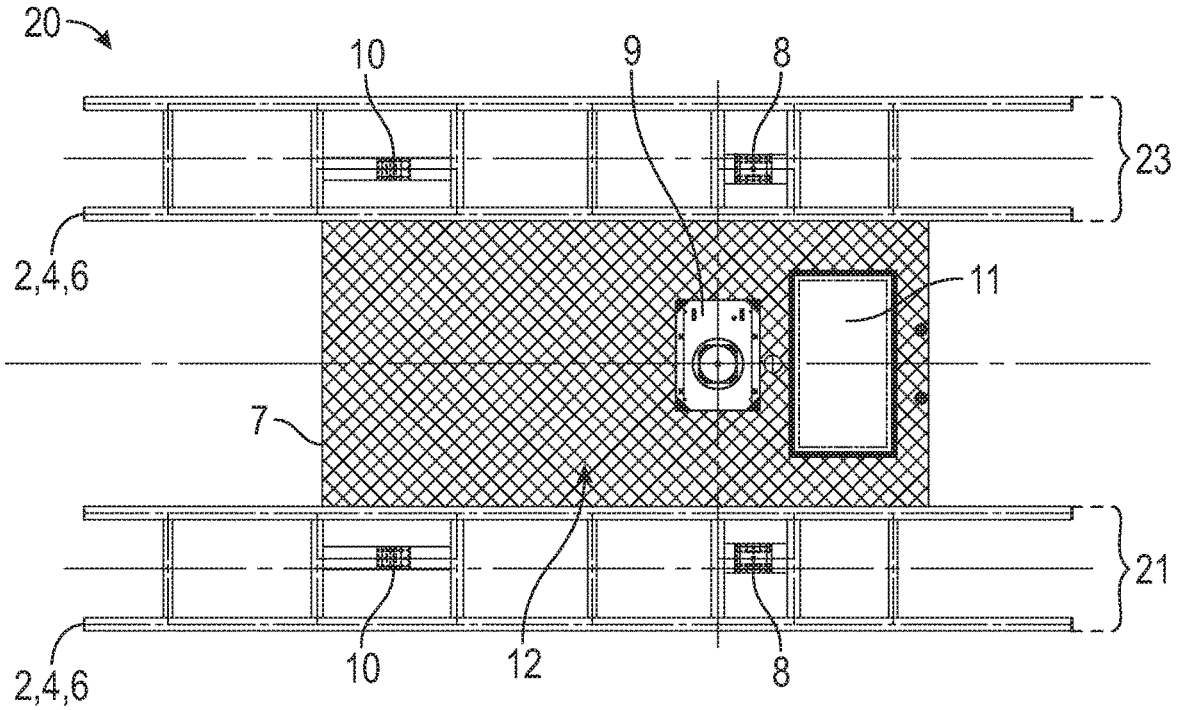
FIG. 1E (Prior Art)
Figure 1F:
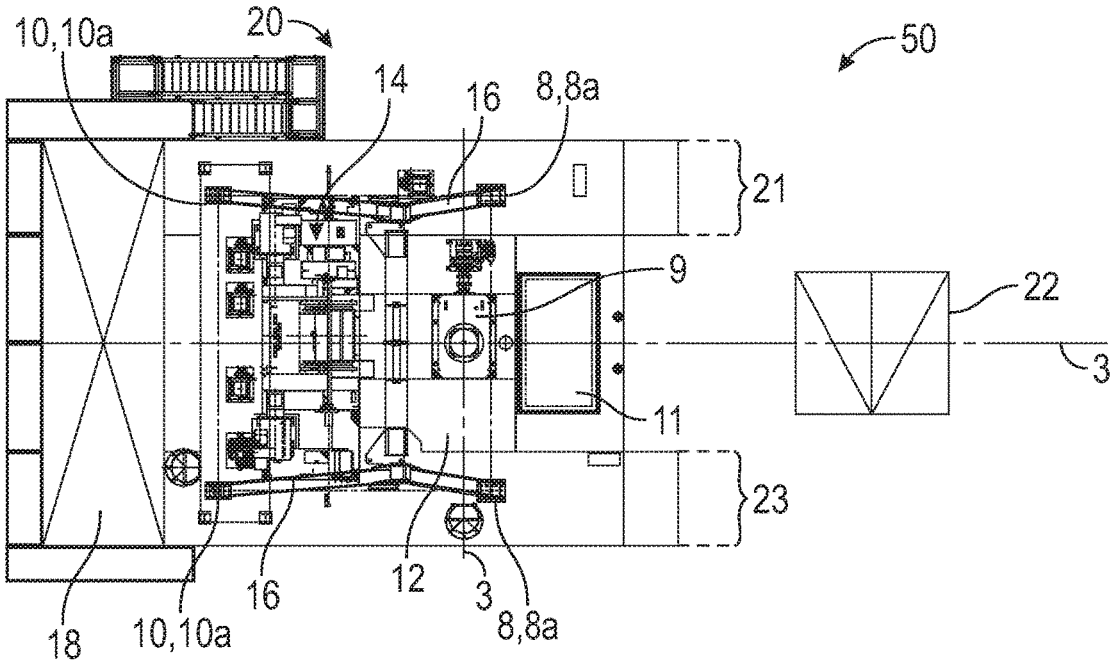
FIG. 1F (Prior Art)
Figure 1G:
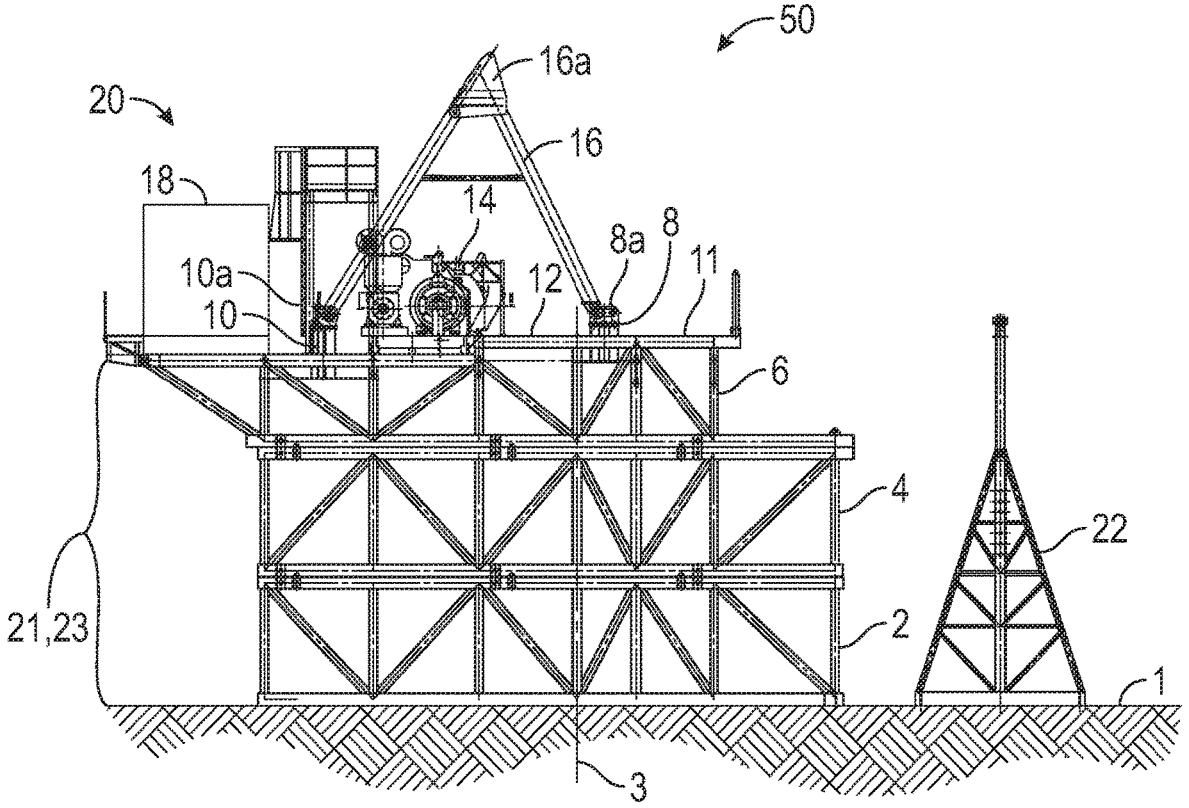
FIG. 1G (Prior Art)
Figure 1H:
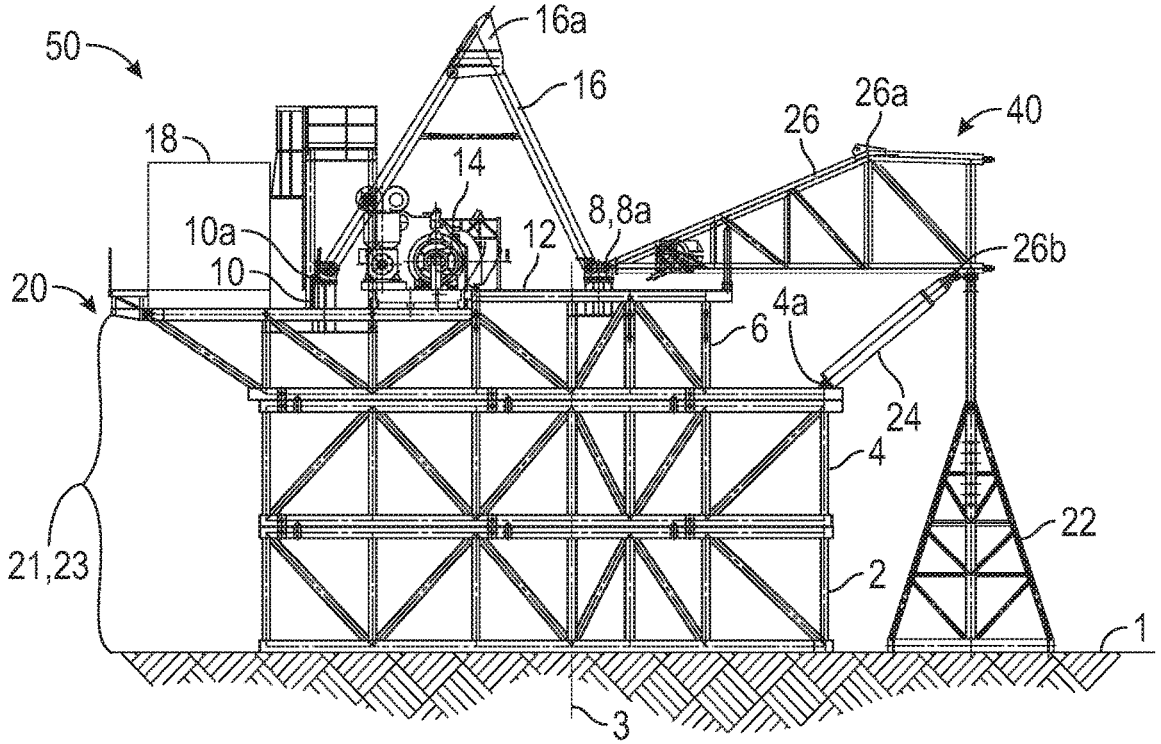
FIG. 1H (Prior Art)
Figure 1I:
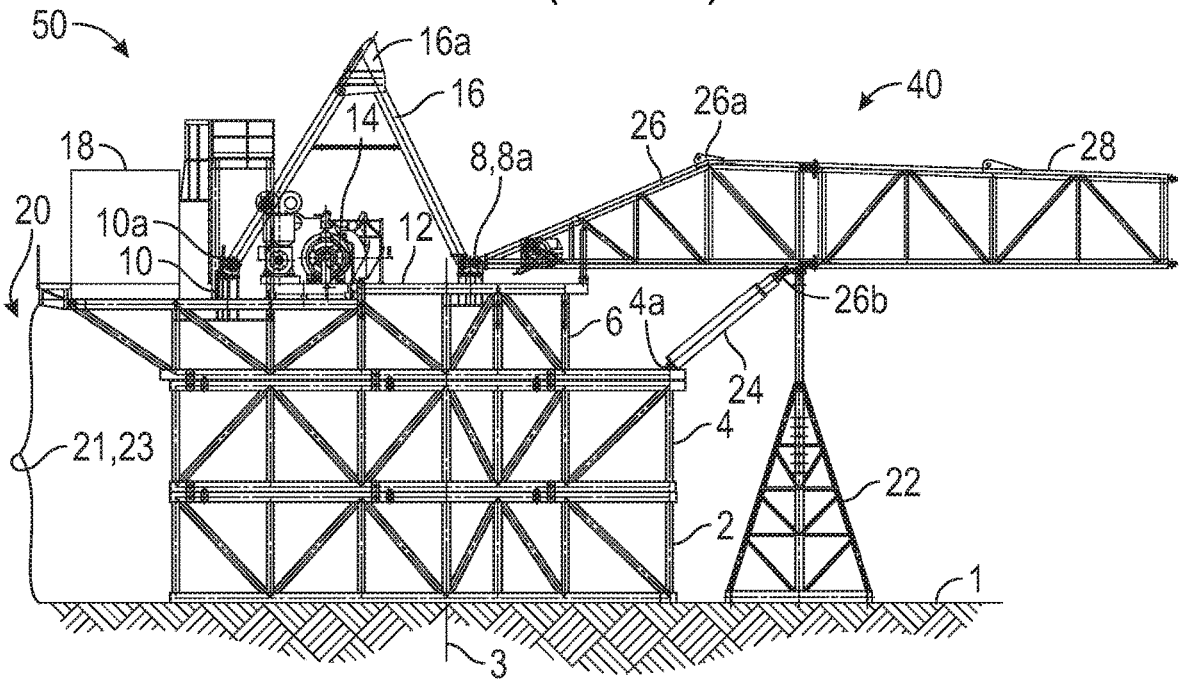
FIG. 1I (Prior Art)
Figure 1J:
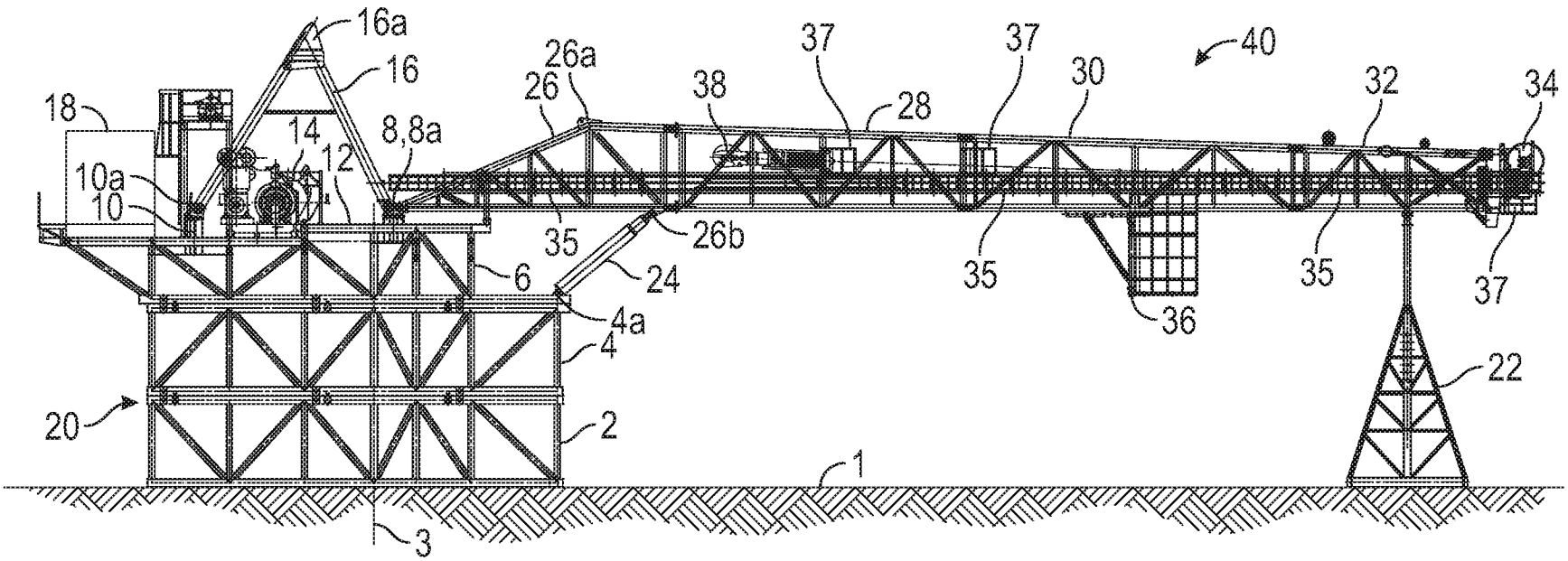
FIG. 1J (Prior Art)
Figure 1K:
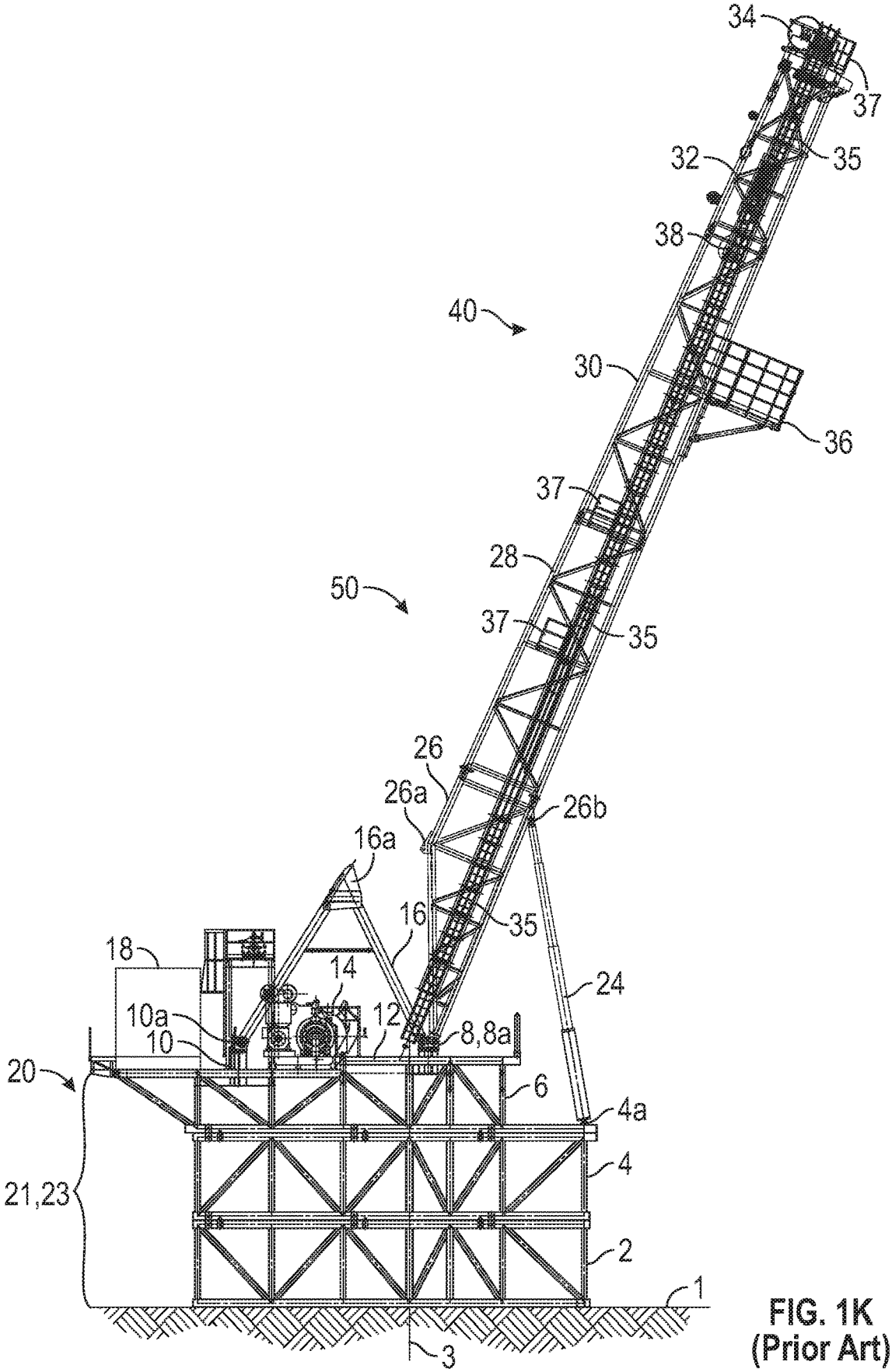
FIG. 1K (Prior Art)
Figure 1L:
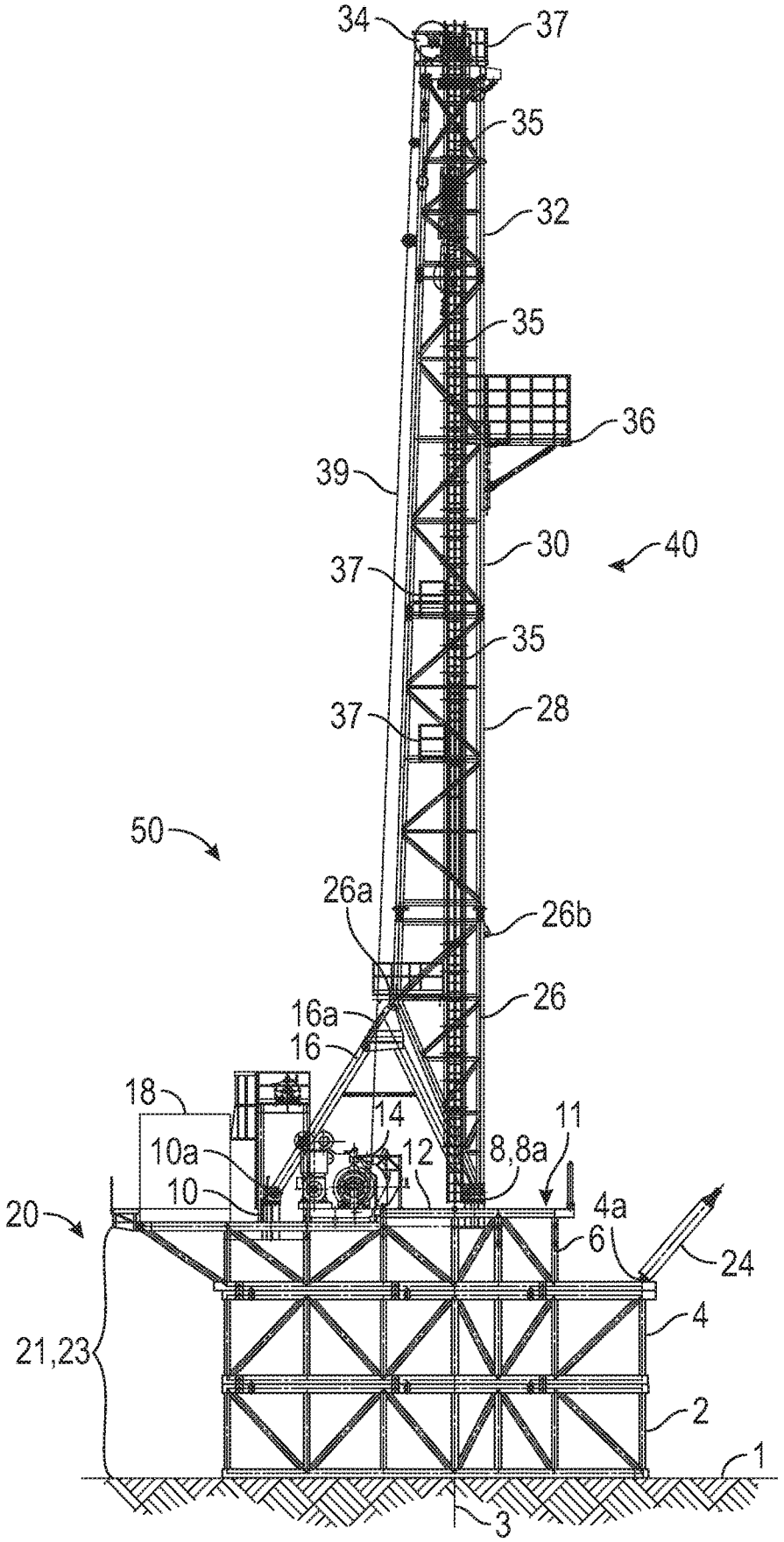
FIG. 1L (Prior Art)

While the subject matter disclosed herein is susceptible to various modifications and alternative forms, specific embodiments thereof have been shown by way of example in the drawings and are herein described in detail. It should be understood, however, that the description herein of specific embodiments is not intended to limit the subject matter defined by the appended claims to the particular forms disclosed, but on the contrary, the intention is to cover all modifications, equivalents, and alternatives falling within the spirit and scope of the claimed subject matter.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

As used in this description and in the appended claims, the terms "substantial" or "substantially" are intended to conform to the ordinary dictionary definition of that term, meaning "largely but not wholly that which is specified." As such, no geometrical or mathematical precision is intended by the use of terms such as "substantially flat," "substantially perpendicular," "substantially parallel," "substantially circular," "substantially elliptical," "substantially rectangular," "substantially square," "substantially aligned," and/or "substantially flush," and the like. Instead, the terms "substantial" or "substantially" are used in the sense that the described or claimed component or surface configuration, position, or orientation is intended to be manufactured, positioned, or oriented in such a configuration as a target. For example, the terms "substantial" or "substantially" should be interpreted to include components and surfaces that are manufactured, positioned, or oriented as close as is reasonably and customarily practicable within normally accepted tolerances for components of the type that are described and/or claimed. Furthermore, the use of phrases such as "substantially conform" or "substantially conforms" when describing the configuration or shape of a particular component or surface, such as by stating that "the configuration of the component substantially conforms to the configuration of a cube" should be interpreted in similar fashion.

Furthermore, it should be understood that, unless otherwise specifically indicated, any relative positional or directional terms that may be used in the descriptions set forth below—such as "upper," "lower," "above," "below," "over," "under," "top," "bottom," "vertical," "horizontal," "lateral," and the like—have been included so as to provide additional clarity to the description, and should be construed in light of that term's normal and everyday meaning relative to the depiction of the components or elements in the referenced figures. For example, referring to the elevation view of the rig substructure 120 depicted in FIG. 6C, it should be understood that the upper substructure box 106 is depicted as being positioned "above" the middle substructure box 104 and the base substructure boxes 102*d*/102*s* are depicted as being positioned "below" middle substructure box 104 and "above" the ground 101. Additionally, the drilling rig mast assembly 140 is depicted in FIG. 6N as being substantially "horizontally" oriented, and is also depicted in FIGS. 2A-2B and FIGS. 6P-6N as being substantially "vertically" oriented.

Figure 2A:
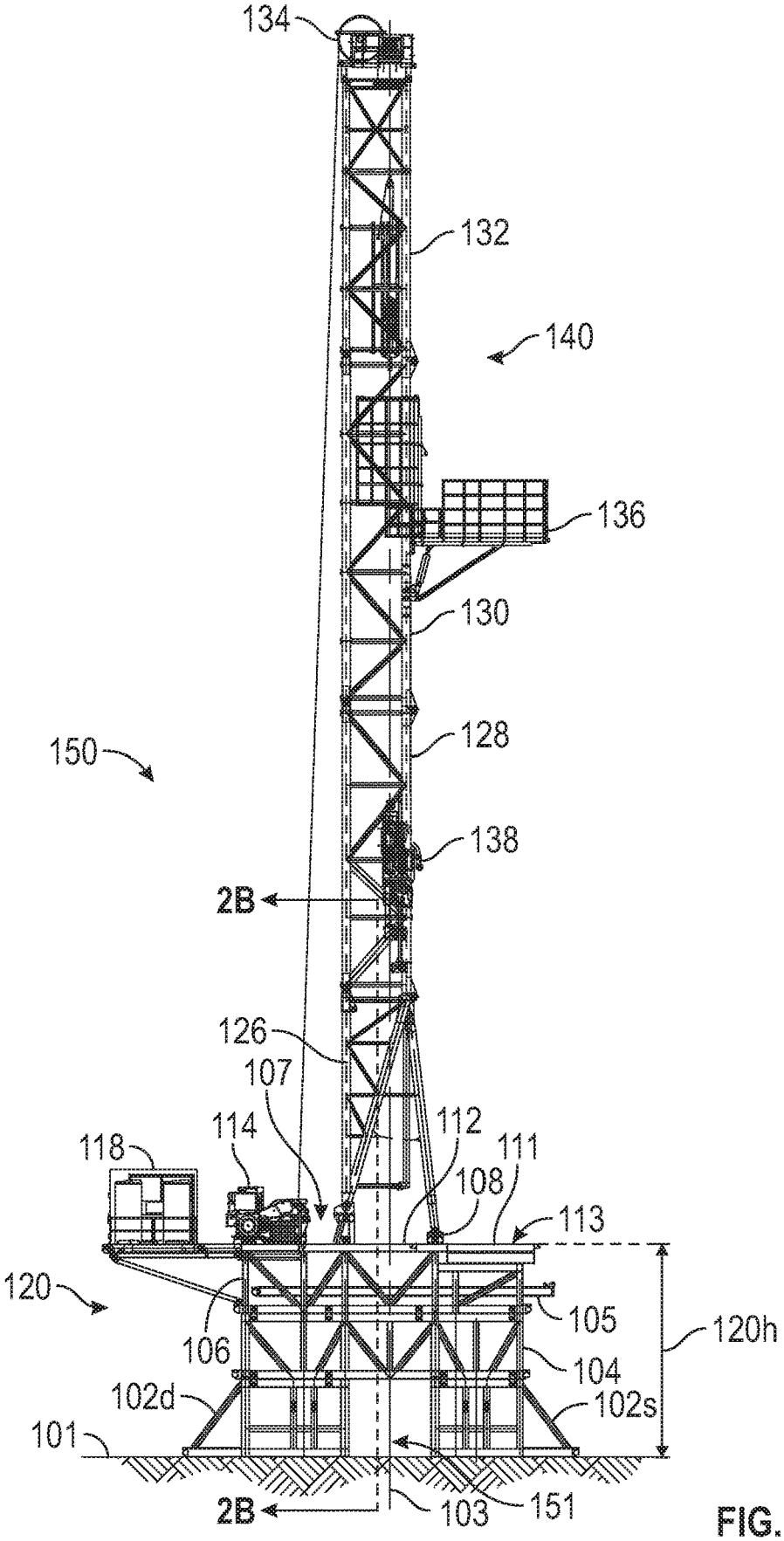
FIG. 2A is an elevation view of an exemplary drilling rig structure according to the present disclosure when viewed from the driller's side of the rig.
Figure 2B:
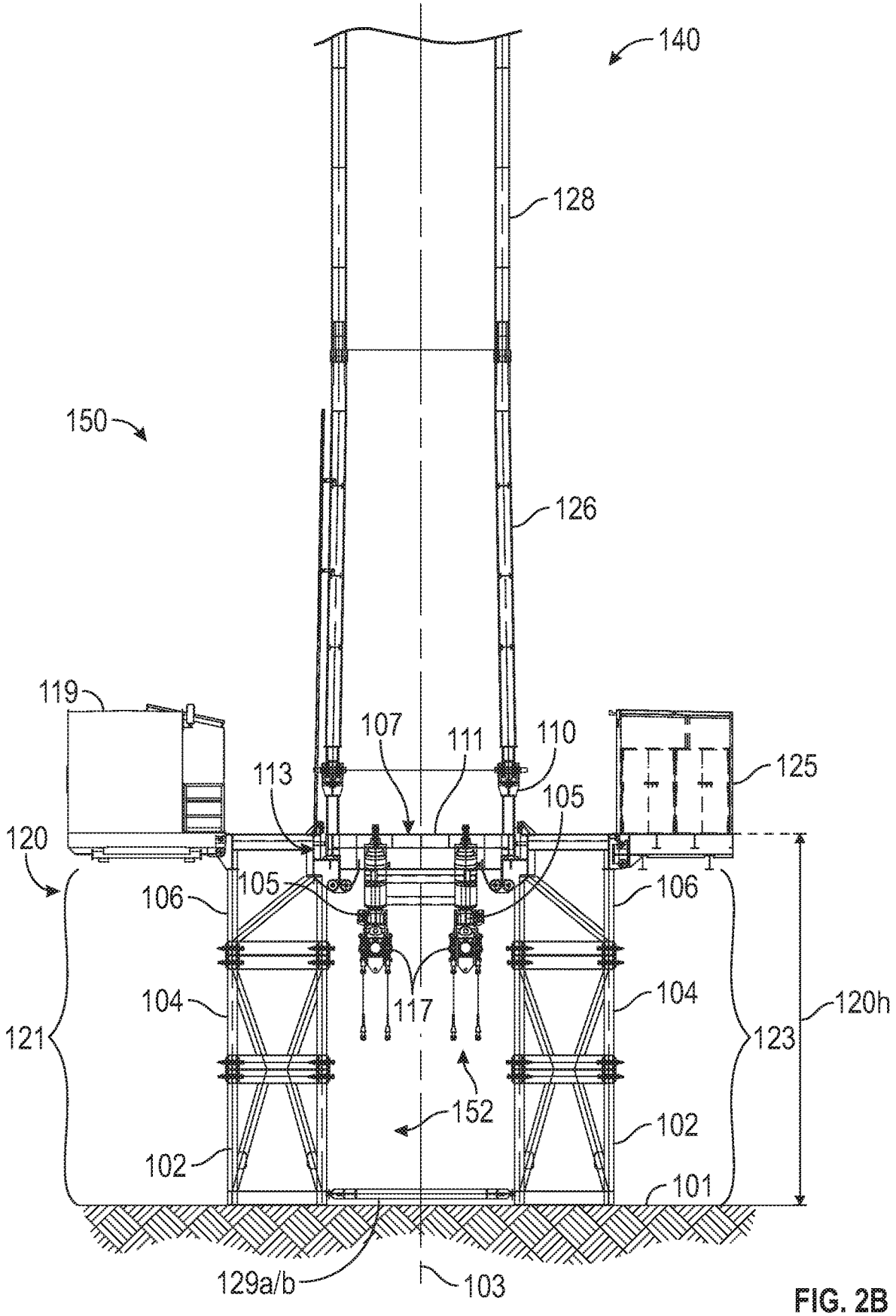
FIG. 2B is an elevation view of the exemplary drilling rig structure shown in FIG. 2A when viewed along the view line "2B-2B" from the setback/V-door side of the rig.

FIG. 2A is an elevation view of an exemplary drilling rig structure 150 in accordance with the present disclosure when viewed from the driller's side of the drilling rig structure 150, and FIG. 2B is a partial elevation view of the drilling rig structure 150 along the view "2B-2B" of FIG. 2A, that is, when viewed from the setback side or V-door side of the drilling rig structure 150. As shown in FIGS. 2A and 2B, the drilling rig structure 150 may include a "box-on-box" type support substructure 120 that is positioned above a wellbore 103, and the substructure 120 in turn supports a drilling rig mast assembly 140 that is removably attached to the substructure 120. In certain embodiments, the substructure 150 may also support a drawworks 114 and a local equipment room (LER) house 118 (FIG. 2A) as well as a driller's cabin 119 and an off-driller's side (ODS) platform 125 (FIG. 2B). So as to not obscure aspects of the disclosure, the drawworks 114 and the LER house 118 are not depicted in FIG. 2B, and the driller's cabin 119 and the ODS platform 125 are not depicted in FIG. 2A.

As shown in FIG. 2B, the support substructure 120 includes a driller's side stacked substructure box assembly 121 and an off-driller's side stacked substructure box assembly 123, and the two stacked substructure box assemblies 121, 123 are spaced apart and positioned so as to straddle the vertical centerline of the wellbore 103. Furthermore, as noted previously each stacked substructure box assembly 121, 123 may have a "box-on-box" configuration. As used herein and in the appended claims, the term "box-on-box" shall mean a configuration wherein the substructure 120 includes a plurality of fabricated substructure boxes that are vertically stacked one on top of another so as to achieve the desired overall height 120*h* of the substructure 120. Accordingly, for the exemplary drilling rig structure 150 depicted in FIGS. 2A and 2B, the "box-on-box" configuration of the stacked substructure box assemblies 121, 123 may therefore include a lower substructure box 102 that is positioned on the ground 101 (or on a drilling mat positioned on the ground 101), a middle substructure box 104 that is positioned on and removably attached to the upper end of the bottom box 102, and an upper substructure box 106 that is positioned on and removably attached to the upper end of the middle box 104.

In some embodiments, the lower substructure box 102 may include two separate spaced-apart base substructure boxes 102*d* and 102*s*. For example, as is best shown in FIG. 2A, the first base box 102*d* may be positioned toward the drawworks side of the drilling rig substructure 150 and the second base box 102*s* may generally be positioned toward the setback side of the drilling rig structure 150 and spaced apart from the first base box 102*d* so as to provide an opening 151 that is defined on either side by the base boxes 102*d/s* and from above by the lower end of the middle substructure box 104. The opening 151 may thus provide access to the cellar area 152 (FIG. 2B) along a lateral axis of the substructure 120 that extends from the driller's side to the off-driller's side of the drilling rig structure 150 (i.e., along the view shown in FIG. 2A) and is substantially orthogonal to a longitudinal axis of the substructure 120 that extends from the setback side to the drawworks side of the drilling rig substructure 150 (i.e., along the view shown in FIG. 2B) and is substantially parallel to the major length of each of the two spaced-apart stacked substructure box assemblies 121, 123.

In other embodiments, one or both of the lower substructure boxes 102 may be a unitized bottom box 102, wherein the upper ends the two base substructure boxes 102*d/s* are removably or fixedly attached together by one or more additional structural elements (not shown in FIG. 2A or 2B) of appropriate size and length such that the one or more additional structural elements, rather than the lower end of the middle substructure box 104, define the side opening 151 from above, thus providing the above-noted lateral access to the substructure cellar area 152.

As shown in FIGS. 2A and 2B and described above, the stacked substructure box assemblies 121 and 123 are each depicted as including three levels of stacked substructure boxes—that is, a lower substructure box 102, a middle substructure box 104, and an upper substructure box 106. However, it should be appreciated by those of ordinary skill after a complete reading of the present disclosure that a stacked substructure box assembly having the three depicted levels of substructure boxes is exemplary only, as the total number levels used for any given embodiment may vary depending on the particular application and the associated design parameters of the drilling rig substructure 150. For example, in some embodiments the stacked substructure box assemblies 121, 123 may include only two levels of stacked substructure boxes, whereas in other embodiments the stacked substructure box assemblies 121, 123 may include four or more levels of stacked substructure boxes based on the particular application. Accordingly, the three-level stacked substructure embodiment illustrated in FIGS. 2A and 2B should not be considered as limiting in any way on the disclosed subject matter unless otherwise specifically defined as such in the appended claims.

With continuing reference to FIGS. 2A and 2B, the drilling rig structure may also include a center floor structure 107 that is removably attached to and spans between the upper substructure boxes 106 of the two stacked substructure box assemblies 121, 123. Furthermore, a drill floor 112 is positioned on the upper surface of the center floor section and is adapted to support tools, equipment, and rig personnel during the various phases of rig operations. In some embodiments, the drilling rig structure 150 includes a setback spreader section 113 that is also removably attached to and spans between the two upper substructure boxes 106, and which includes a setback area 111 that is adapted to support stands of casing and/or drill pipe while performing drilling activities. As shown in FIG. 2B, the center floor structure 107 and the setback spreader section 113 are generally positioned above the cellar area 152 substructure 120 and above the wellbore 103. Depending on the drilling rig design and the particular application, the overall height 120*h* of the substructure 120 from the ground 101 to the drill floor 112 and/or the setback area 111 may be in range of approximately 18 ft to 35 ft (5.5 m to 10.7 m) or even greater, although it should be appreciated that substructure heights 120*h* less than approximately 18 ft (5.5 m) may also be utilized without affecting the function, use, and novelty of the concepts disclosed in this description.

In certain embodiments, one or more trolley beams 105 and trolley hoists 117 that are used lift, move, and position a blowout preventer (BOP, not shown) on a wellhead (not shown) once the wellbore 103 has been completed may be positioned in the cellar area 152 of the substructure 120 below the center floor structure 107 and the setback spreader section 113. Additional details of the center floor structure 107 and the setback spreader section 113 will be further described below in conjunction with FIG. 3, FIGS. 4A-4C, and FIGS. 5A-5C.

In particular embodiments, the substructure 120 may also include one or more lateral positioning spacers 129*a/b* that are attached to and between the lower ends of the lower substructure boxes 102, such as between the base boxes 102*d* and 102*s*. During drilling rig assembly, such lateral positioning spacers 129*a/b* act to provide and maintain the proper lateral spacing between the lower ends of the two stacked substructure box assemblies 121, 123, and furthermore also stabilize the substructure 120 during drilling rig operations.

The drilling rig structure 150 also includes a drilling rig mast assembly 140 that is positioned on and supported by the substructure 120. In certain embodiments, the drilling rig mast assembly 140 may include a bottom mast section 126 that is pivotably coupled to the substructure 120 by way of a rear mast support shoe 110, and the bottom mast section 126 is further supported by the substructure 120 by being removably attached to a front mast support shoe 108. The drilling rig mast assembly 140 also includes a first intermediate mast section 128 that is removably attached to the upper end of the bottom mast section 126, a second intermediate mast section 130 that is removably attached to the upper end of the first intermediate mast section 128, and an upper mast section 132 that is removably attached to the upper end of the second intermediate mast 130. As shown in FIG. 2A, a crown assembly 134 is positioned at the upper end of the drilling rig mast assembly 140, a racking board 136 is mounted to the setback side of the mast and above the setback area 111 of the setback spreader section 113, and a top drive assembly 138 (not shown in FIG. 2B) is positioned within the structure of the drilling rig mast assembly 140.

As is shown in FIGS. 2A and 2B and described above, the drilling rig mast assembly 140 is shown as including four mast sections—that is, a bottom mast section 126, a first intermediate mast section 128, a second intermediate mast section 130, and an upper mast section 132. However, it should be appreciated by those of ordinary skill after a complete reading of the present disclosure that a mast assembly having the four depicted mast section is exemplary only, as the total mast sections used for any given embodiment may vary depending on the particular application and the associated design parameters of the drilling rig substructure 150 and drilling rig mast assembly 140. For example, in some embodiments the drilling rig mast assembly 140 may include fewer than four mast sections, e.g., two or three mast sections, whereas in other embodiments the mast assembly 140 may include more than four mast sections, e.g., five or more mast sections. Accordingly, the four-section drilling rig mast embodiment illustrated in FIGS. 2A and 2B should not be considered as limiting in any way on the disclosed subject matter unless otherwise specifically defined as such in the appended claims.

Figure 3:
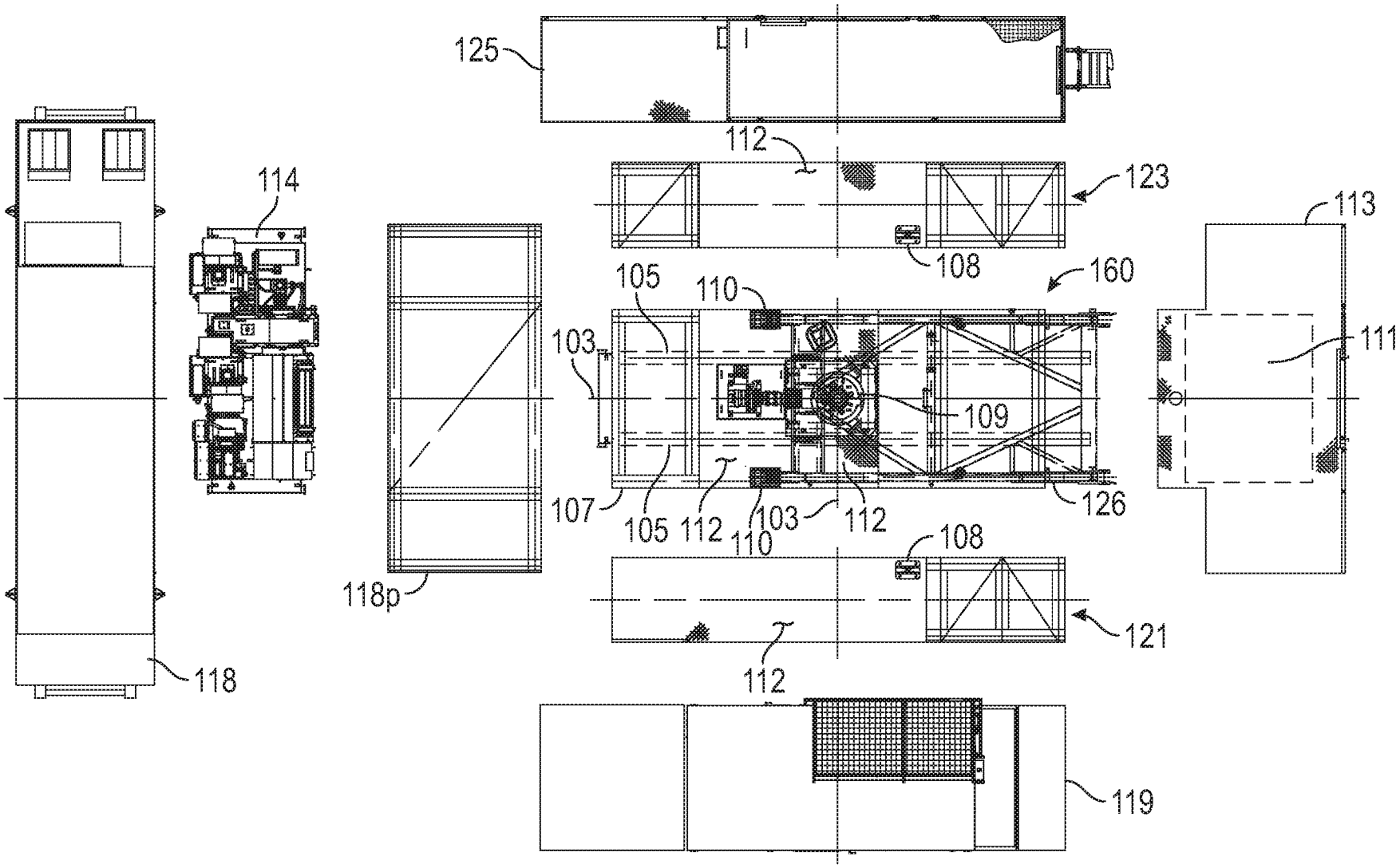
FIG. 3 is an exploded plan view of an illustrative drill floor layout for the drilling rig structure shown in FIGS. 2A and 2B in accordance with some disclosed embodiments.

FIG. 3 is an exploded plan view of one illustrative drill floor layout for the drilling rig structure 150 depicted in FIGS. 2A and 2B, showing the various drilling rig components and elements that are positioned on and/or surround the drill floor 112 of the drilling rig structure 150. As shown in FIG. 3, the drill floor layout may generally include a center drill floor assembly 160 that, when assembled as part of the drilling rig structure 150, will be positioned so as to extend between and be supported by the driller's side stacked substructure box assembly 121 and the off-driller's side stacked substructure box assembly 123. Furthermore, a support structure 118*p* that is adapted to support the LER house 118 is shown in FIG. 3 as being positioned adjacent to the drawworks end of the center floor structure 107 of the center drill floor assembly 160. Additionally, the drawworks 114 and the LER house 118 are both shown in the exploded plan view of FIG. 3 as being positioned on the drawworks side of the center floor structure 107 and the setback spreader section 113 is shown as being positioned adjacent to the setback side of the center drill floor assembly 160. Finally, FIG. 3 shows the driller's cabin 119 as being positioned laterally adjacent to the driller's side stacked substructure box assembly 121 and that the ODS platform 125 is positioned laterally adjacent to the off-driller's side stacked substructure box assembly 123.

As will be further described in conjunction with FIGS. 6G-6L below, during drilling rig assembly the support structure 118*p* will be attached to and supported by the drawworks ends of the two stacked substructure box assemblies 121, 123 and of the center floor structure 107. The setback spreader section 113 will span the space between and be supported by the two stacked substructure box assemblies 121, 123, and will also extend across approximately the full width of each of the setback ends of the two stacked substructure box assemblies 121, 123. Furthermore, the drawworks 114 will be positioned above the drawworks end of the center floor structure 107, the LER house 118 will be positioned on and supported by the support structure 118*p*, the driller's cabin 119 will be attached to and supported by the upper box 106 of the driller's side stacked substructure box assembly 121, and the ODS platform 125 will be attached to and supported by the upper box 106 of the off-driller's side stacked substructure box assembly 123.

Figure 4A:
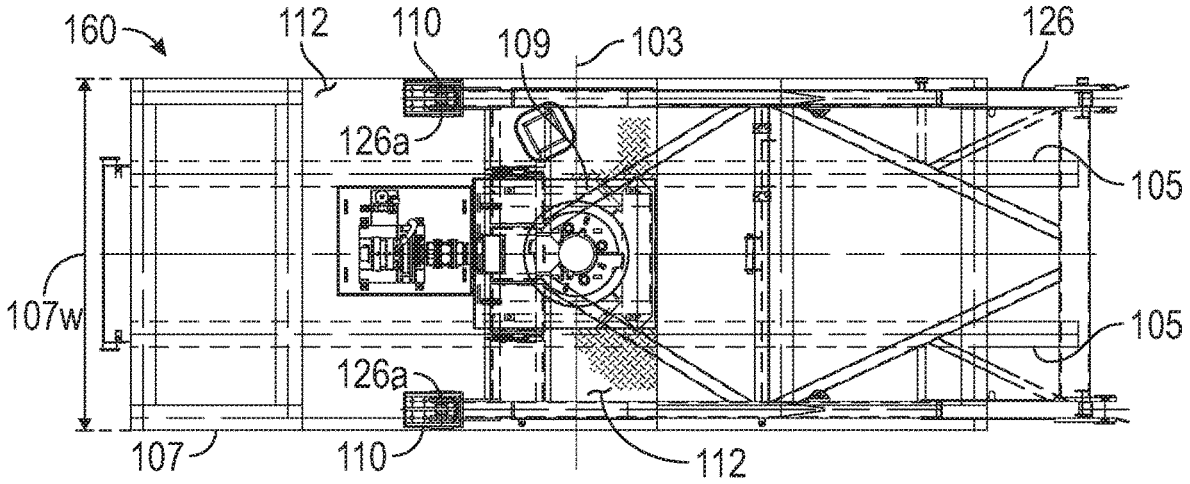
FIG. 4A is a plan view of an illustrative center drill floor assembly for of the exemplary drilling rig structure shown in FIGS. 2A and 2B in accordance with disclosed embodiments.
Figure 4B:
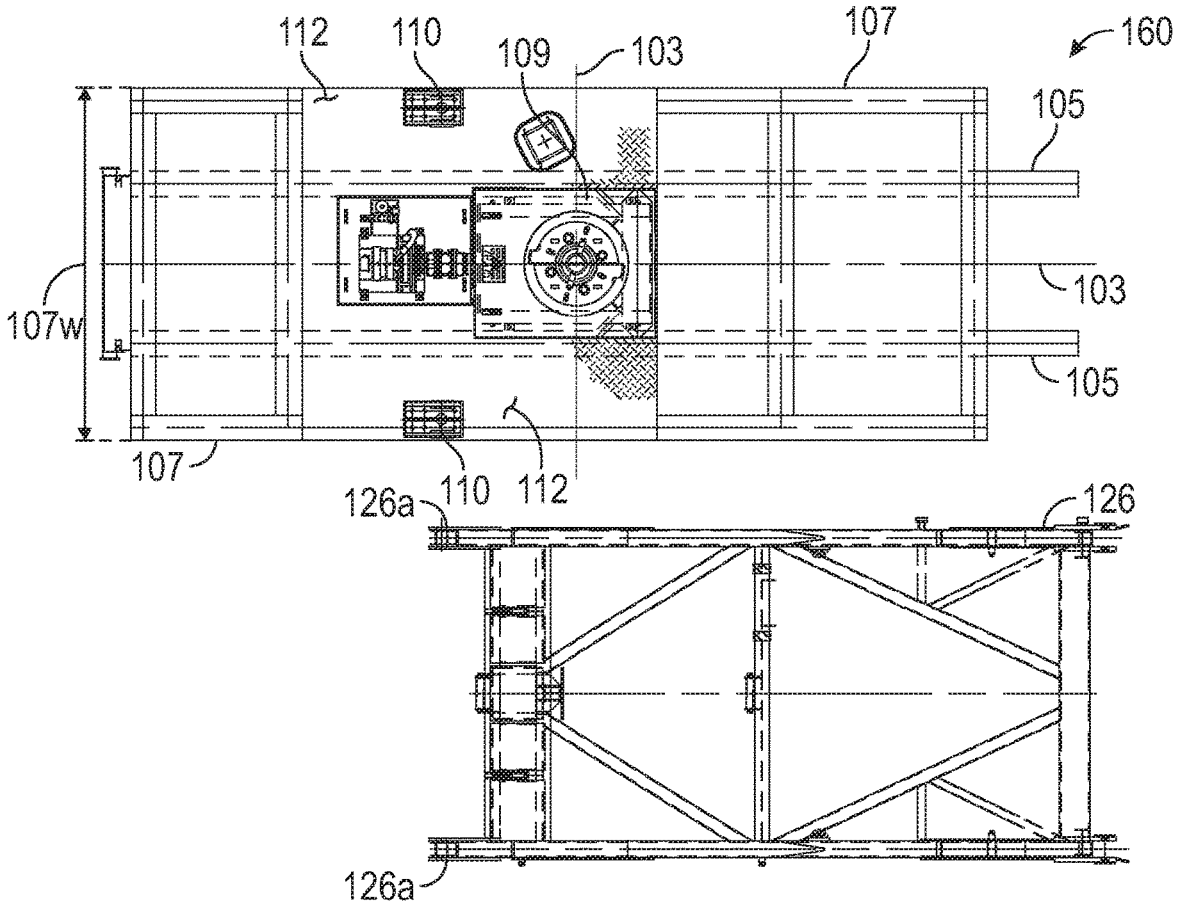
FIG. 4B is an exploded plan view of the illustrative center drill floor assembly depicted in FIG. 4A.
Figure 4C:
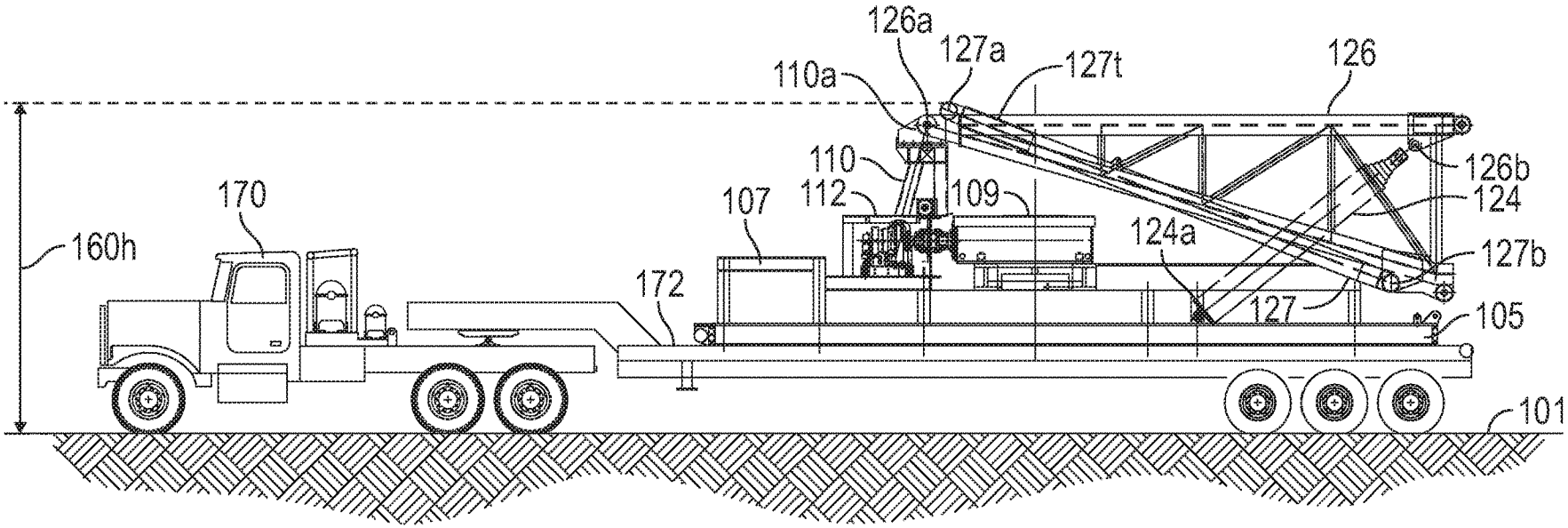
FIG. 4C is an elevation view of the illustrative center drill floor assembly shown in FIGS. 4A and 4B as loaded out for transportation on a truck/trailer combination.

FIGS. 4A-4C illustrate various detailed aspects of the center drill floor assembly 160 shown in FIG. 3. In particular, FIG. 4A is a more detailed plan view of the center drill floor assembly 160, FIG. 4B is an exploded plan view of the center drill floor assembly 160 of FIG. 4A, and FIG. 4C is a detailed elevation view of the center drill floor assembly 160 as loaded out on a truck/trailer combination 170/172 for transportation to and from a drilling site. As shown in FIGS. 4A-4C, the center drill floor assembly 160 includes a center floor structure 107 that supports at least part of the drill floor 112 and has a width 107*w* that is approximately equal to the space between the upper substructure boxes 106 of the two stacked substructure box assemblies 121, 123. Additionally, a rotary drill table 109 and the rear mast support shoes 110 may also be mounted on and supported by the center floor structure 107. As is best shown in FIG. 4C, in some embodiments a pinned structural connector 110*a* may be fixedly or removably attached to each of the two rear mast support shoes 110 (one shown in FIG. 4C) mounted on the center floor structure 107, which may in turn be used to pivotably attach the two lower pinned mast connections

126*a* at the lower end the bottom mast section 126 to the rear mast support shoes 110. In other embodiments, the BOP trolley beams 105 may also be attached to and supported by the center floor structure 107 in an appropriate location for handling and positioning a BOP during rig operations.

As is best shown in FIG. 4C, the bottom mast section 126 may be positioned within the center floor structure 107 such that part of the upper end of the bottom mast section 126 (shown as being oriented to the right in FIG. 4C) is at least partially recessed, or "nested," below the level of the drill floor 112 and an upper surface of the rotary drill table 109. This "nesting" configuration of the bottom mast section 126 within the center floor structure 107 allows the overall shipping height 160*h* of the center drill floor assembly 160 as loaded out on a truck/trailer combination 170/172 to be substantially minimized during transportation of the center drill floor assembly 160 to and from a drilling site, thus potentially avoiding the need for special transportation permitting, depending on the particular rig design and application and the local regulations along the intended transportation route. For example, in certain illustrative embodiments, the shipping height 160*h* may be in the range of approximately 10 ft to 14 ft (3.0 m to 4.3 m), such as about 12 ft (3.7 m), depending on the configuration of the trailer 172 and the design of the particular center drill floor assembly 160, although it should be appreciated that other shipping heights 160*h* may be envisioned within the scope of the present disclosure.

With continuing reference to FIG. 4C, the bottom mast section 126 may include two front mast support braces 127 (one shown in the elevation view of FIG. 4C) that are adapted to support and stabilize the fully assembled drilling rig mast assembly 140 after the mast assembly 140 has been pivotably raised/erected above the substructure 120. See, FIGS. 2A and 2B. As shown in FIG. 4C, the upper ends of the front mast support braces 127 are pivotably coupled to the bottom mast section 126 at respective upper pinned connections 127*b* that are positioned proximate the upper end of the mast section 126 on opposing driller's and off-driller's sides. Additionally, the lower end of each front mast support brace 127 (shown as being oriented to the left in FIG. 4C) has a lower pinned connection 127*a* that is adapted to be removably attached to a front mast support shoe 108 (or the pinned structural connections 108*a*) mounted on the upper substructure box 106 of a respective stacked substructure box assembly 121, 123 after the drilling rig mast assembly 140 has been raised/erected. Furthermore, the front mast support braces 127 may include a telescoping structural connection 127*t* that permits the length of the support braces 127 to be adjusted and fixed as required in order to fit up the lower pinned connections 127*a* to the pinned structural connections 108*a* on the respective front mast support shoes 108.

Also as shown in FIG. 4C, the center drill floor assembly 160 may include two mast raising apparatuses 124 (one shown in FIG. 4C) having lower ends that are pivotably attached to respective pinned connections 124*a* mounted on the center floor structure 107 of the center drill floor assembly 160. The mast raising apparatuses 124 may be used for raising the fully assembled drilling rig mast assembly 140 above the substructure 120 after the upper ends of the raising apparatuses 124 have been pivotably attached to suitably designed upper pinned connections 126*b* that are positioned proximate the upper end of the bottom mast section 126. For additional details of an exemplary drilling rig mast assembly and erection procedure in accordance with the present disclosure, see FIGS. 6L-6Q, described below.

The mast raising apparatuses 124 may be, for example, telescoping hydraulic or pneumatic cylinders, such as single-acting or double-acting cylinders, and the like. Of course, it should be appreciated that other suitable raising apparatuses known in the art may also be used, such as mechanical screw-type apparatuses or wire lines and the like, depending on the particular design parameters of the overall drilling rig structure 150 and/or the drilling rig mast assembly 140 (see, FIG. 6N).

As indicated in the background section of this disclosure, the assembly of a drilling rig structure that utilizes a "box-on-box" type of substructure configuration can be cumbersome and time consuming when cranes are required to lift, move, and position individual rig components during the rig assembly process. This is particularly true for more critical fit-up operations that might be adversely affected by local site weather conditions, e.g. wind and the like, such as when a fully assembled drilling rig mast, or at least the bottom mast section of a drilling rig mast assembly, is lifted, moved into position, and fit up to a pinned connection on a mast support shoe. However, the exemplary center drill floor assembly 160 illustrated in FIGS. 4A-4C can readily be fully assembled in a shop environment and then packaged and shipped to a drilling site as a single modular assembly that includes at least the center floor structure 107, the rear mast support shoes 110 (and pinned structural connectors 110*a*, when used) mounted to the center floor structure 107, and the bottom mast section 126 pivotably connected to the rear mast support shoes 110 (or pinned structure connectors 110*a*, when used). Furthermore, as will be further discussed below in conjunction with FIGS. 6E and 6F, such a "modular" center drill floor assembly 160 can be lifted, moved, positioned on, and attached to the upper substructure boxes 106 of the two spaced-apart stacked substructure box assemblies 121, 123 as a single component, rather than the two or three separate components that are typically necessary for the prior art drilling rig structures. Furthermore, due to the magnitude of the height 120*h* of the substructure 120 that is commonly used for "box-on-box" type configurations, an operation that involves simply dropping a single modular center drill floor assembly 160 into place and attaching it to the stacked substructure box assemblies 121, 123 is less complex, and therefore easier to accomplish, than fitting up the two lower pinned connections 126*a* of the bottom mast section 126 to the two respective rear mast support shoes 110, or to the two pinned structural connectors 110*a* as may be the case. As such, use of the modular center drill floor assembly 160 can streamline and simplify at least some aspects of the drilling rig assembly process, thus reducing the time required to complete the rig assembly and a commensurate overall cost reduction for rig preparation and startup.

Figures 5A, 5B, 5C:
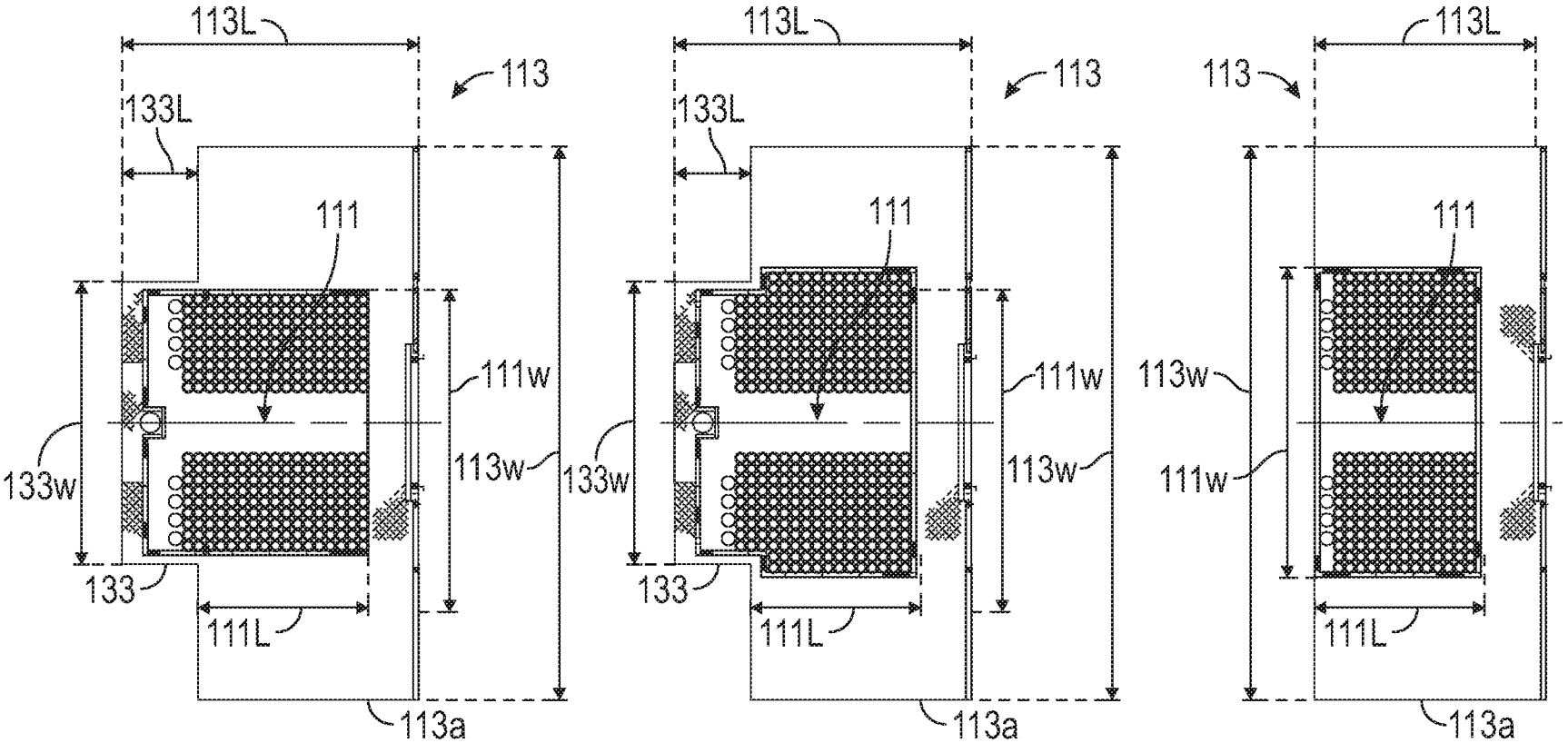
FIGS. 5A-5C are plan views depicting various exemplary setback spreader sections of the drill floor for embodiments of the exemplary drilling rig structure shown in FIGS. 2A and 2B and in the drill floor layout of FIG. 3.

FIGS. 5A-5C are plan views depicting various exemplary embodiments of the setback spreader section 113 of the exemplary drilling rig structure 150 shown in FIGS. 2A and 2B and in the drill floor layout of FIG. 3. As shown in FIGS. 5A-5C, each exemplary setback spreader section 113 has an overall rectangular configuration, although the two configurations depicted in FIGS. 5A and 5B have an extended center section 133 that extends or protrudes away from a primary portion 113*a* the setback spreader section 113 toward the drawworks side of the drilling rig structure 150 (oriented to the left in FIGS. 5A and 5B). Furthermore, each of the setback spreader sections 113 may have an overall width 113*w* that is approximately the same as the overall width 120*w* of the substructure 120 in the as-assembled configuration (see, FIG. 6D), such that when the setback spreader section 113 is installed on the substructure 120 it extends across approximately the full width of the upper substructure boxes 106 of the two stacked substructure box assemblies 121, 123. Additionally, the setback spreader sections 113 each have an overall length 113L.

With reference to the optional configurations depicted in FIGS. 5A and 5B, the extended center section 133 has a length 133L that is included in the overall length 113L of the setback spreader sections 113. In certain embodiments, the extended center section 133 has a width 133*w* that is approximately the same as the width 107*w* of the center floor structure 107 (see, FIGS. 4A and 4B), or approximately equal to the space between the upper substructure boxes 106 of the two stacked substructure box assemblies 121, 123. In general, the extended center section 133 is adapted to provide additional space within the setback area 111 for increasing the quantity of casing and/or drill pipe stands that can be staged in the setback area 111 as may be necessary for a particular drilling application, particularly when compared to the optional configuration depicted in FIG. 5C. Additionally, the setback area 111 of the embodiment shown in FIG. 5B is depicted as having an increased width 111*w* relative to the configuration shown in FIG. 5A, thus providing another optional approach for increasing the quantity of drill pipe stands that can be staged in the setback area 111 for drilling operations.

As noted, the optional setback spreader section 113 depicted in FIG. 5C does not include the extended center section 133, and therefore may typically have a smaller overall length 113L. While such a configuration may result in a somewhat reduced capability for staging casing and/or drill pipe stands in the setback area 111 relative to the configurations depicted in FIGS. 5A and 5B, the reduced overall size of the setback spreader section 113 may be sufficient for certain drilling applications. Furthermore, a configuration having such a reduced size may also lead to a reduced overall weight of the setback spreader section 113, thus potentially reducing shipping costs as well as the amount of time that may be needed to lift, move, and install the setback spreader section 113 onto the drilling rig assembly 150. Therefore, due to this design and size flexibility, the configurations of these various embodiments of the setback spreader section 113 can readily be modularized as a single modular section based on specific drilling rig structure designs and/or for particular drilling applications.

As would be appreciated by persons of ordinary skill after a complete reading of the present disclosure, the overall size of the setback spreader section 113 and the setback area 111 may be adjusted as required so as to meet a particular application requirement and/or a specific drilling rig structure design. For example, in some embodiments the size of the setback area 111 may be adjusted by increasing or decreasing the overall length 113L of the setback spreader section 113 and/or the length 111L of the setback area 111. In other illustrative embodiments, the width 113*w* and/or the width 111*w* of the setback area 111 may be adjusted, or both the length 111L and the width 111*w* of the setback area 111 and may be adjusted.

Figure 6E:
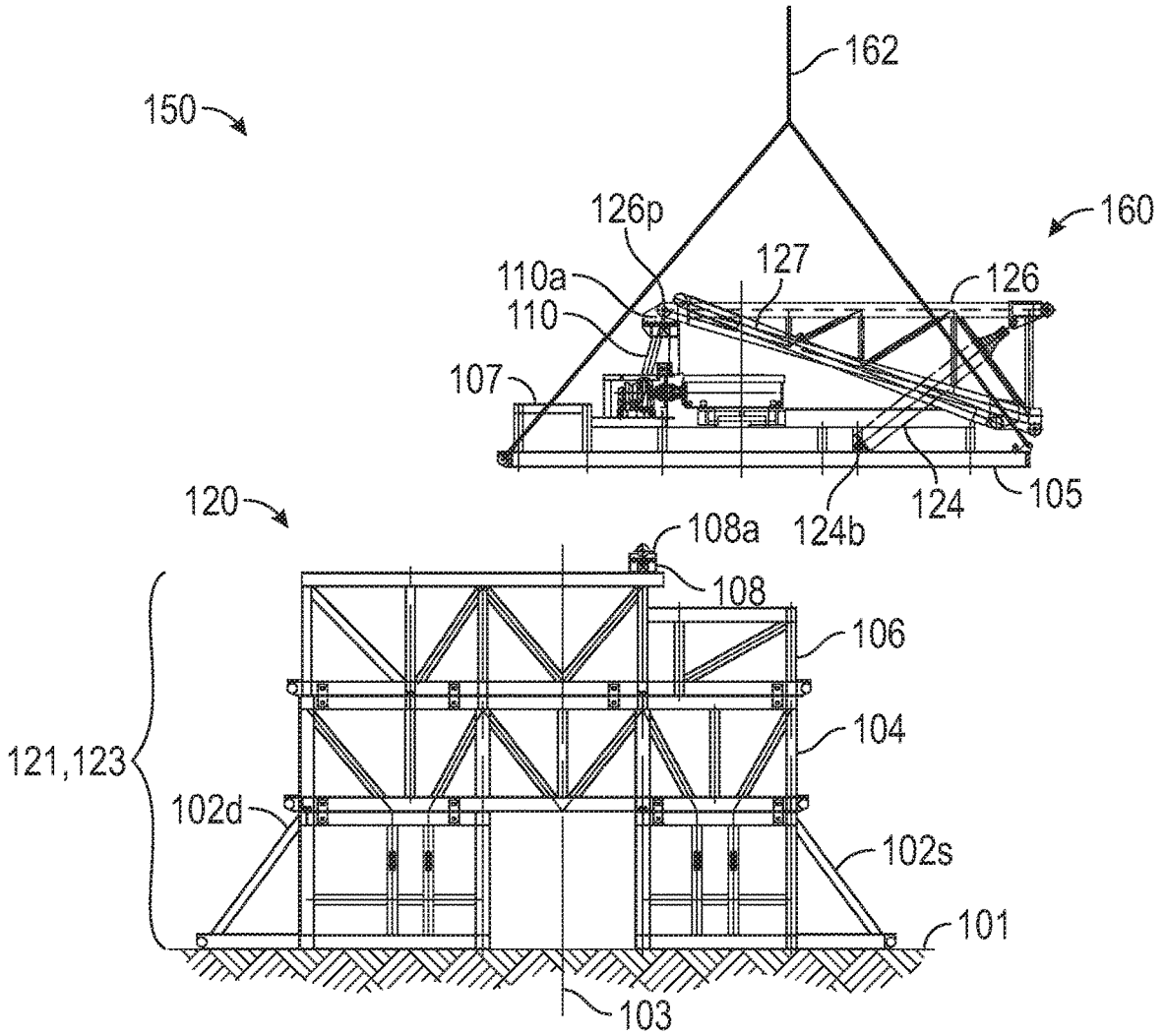
FIGS. 6A-6T show various plan and elevation views of illustrative steps for assembling and erecting an exemplary drilling rig structure and associated rig components as depicted in FIGS. 2A-5C according to certain aspects of the present disclosure.
Figure 6F:
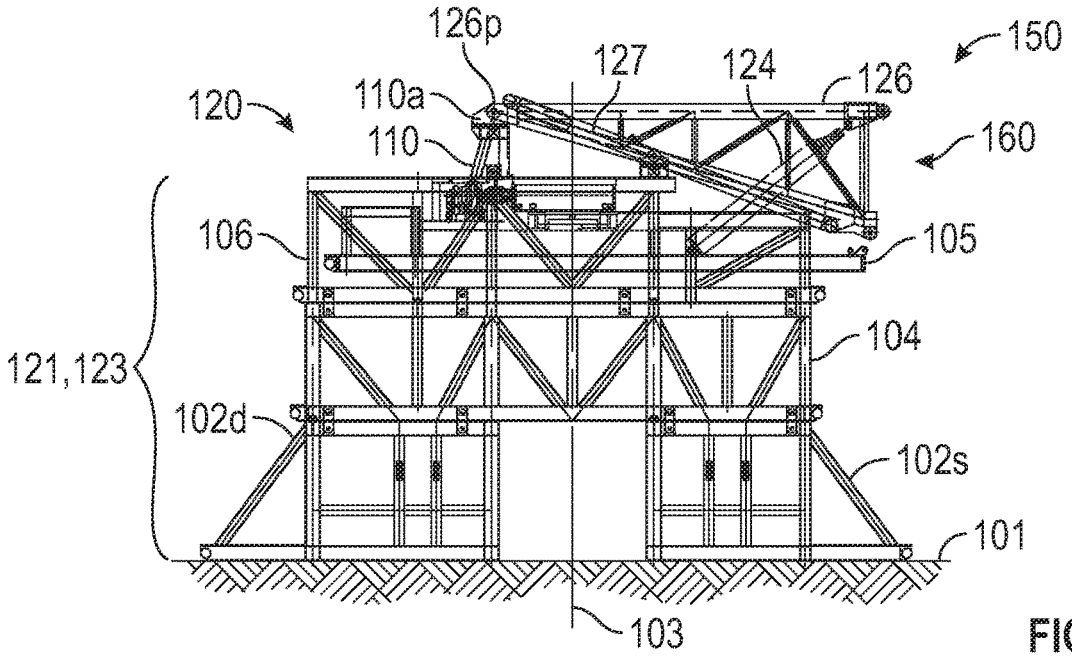
Figure 6G:
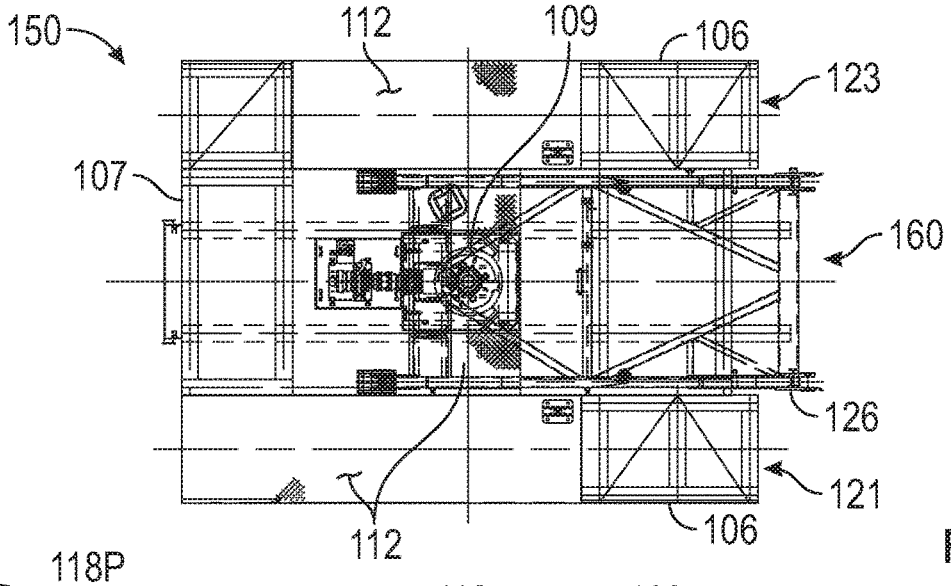
Figure 6H:
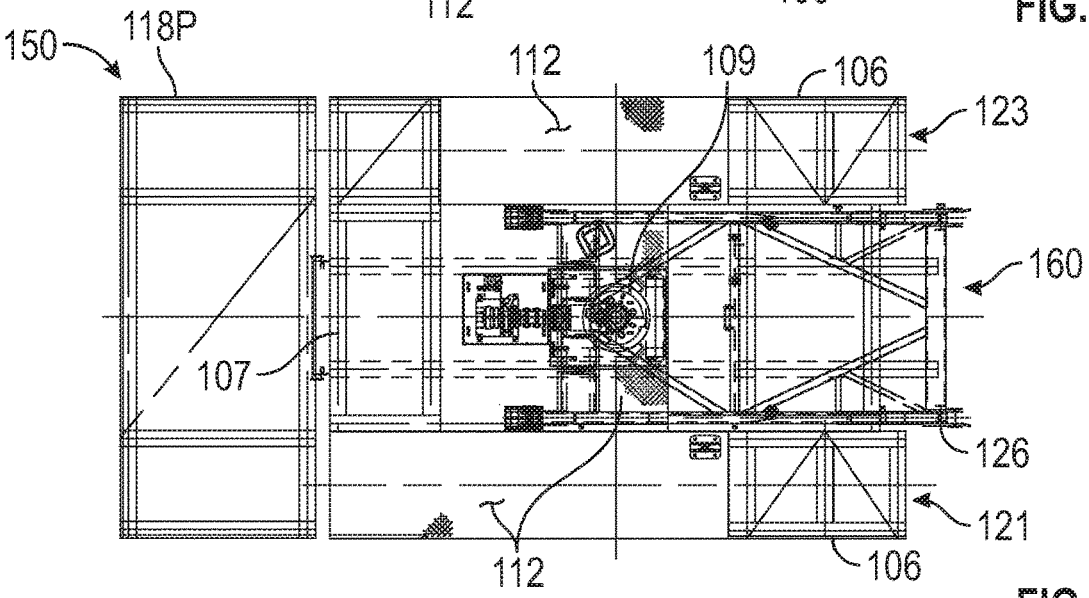
Figure 6I:
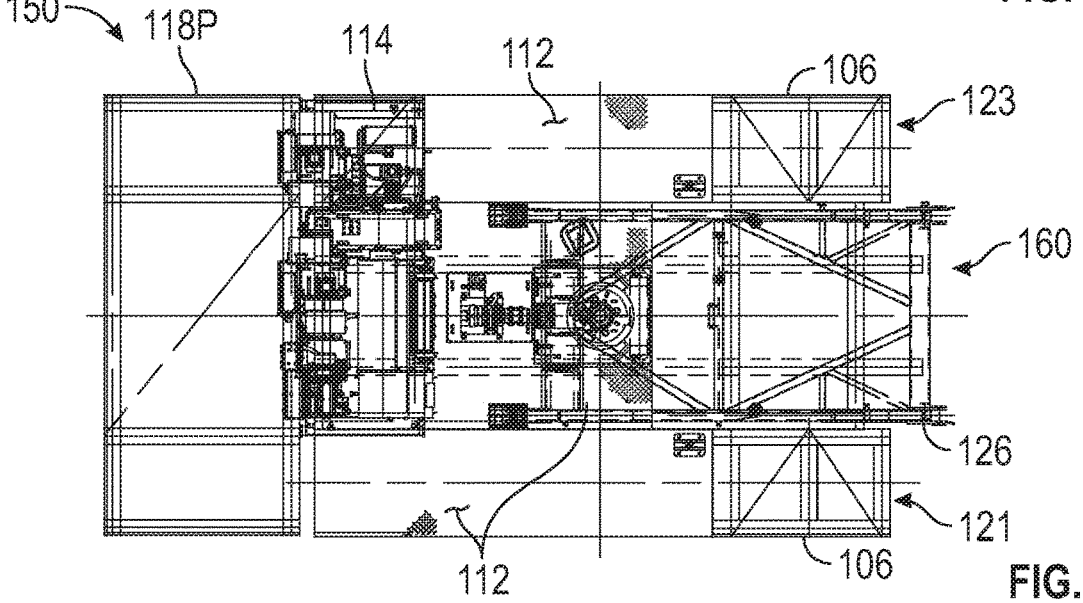
Figure 6J:
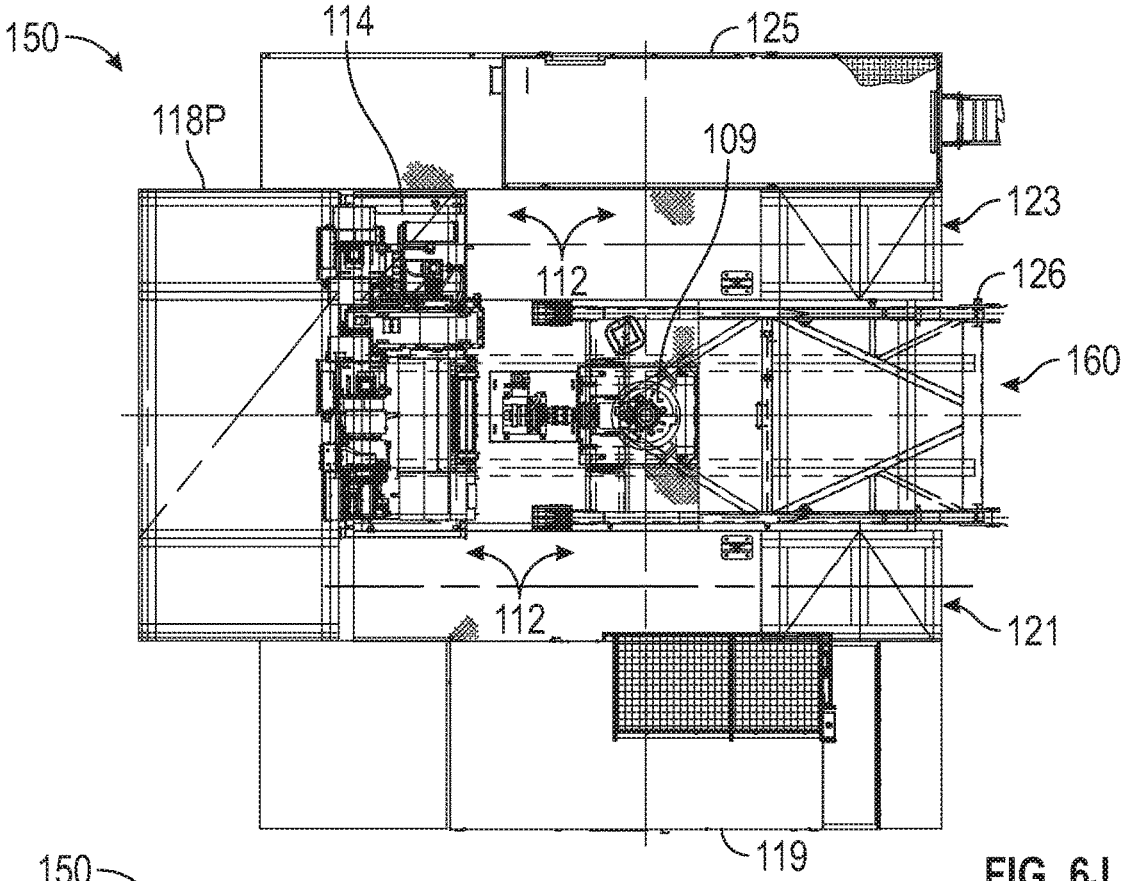
Figure 6K:
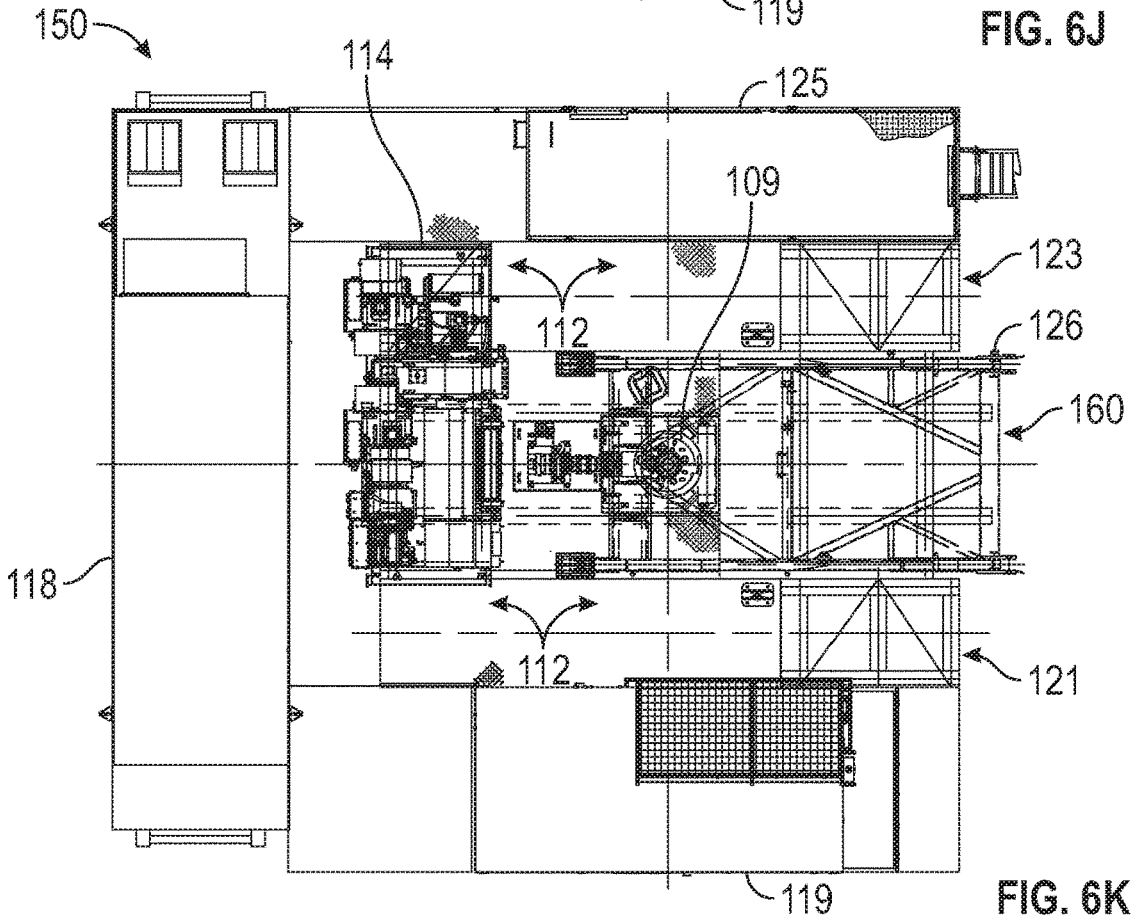
Figure 6L:
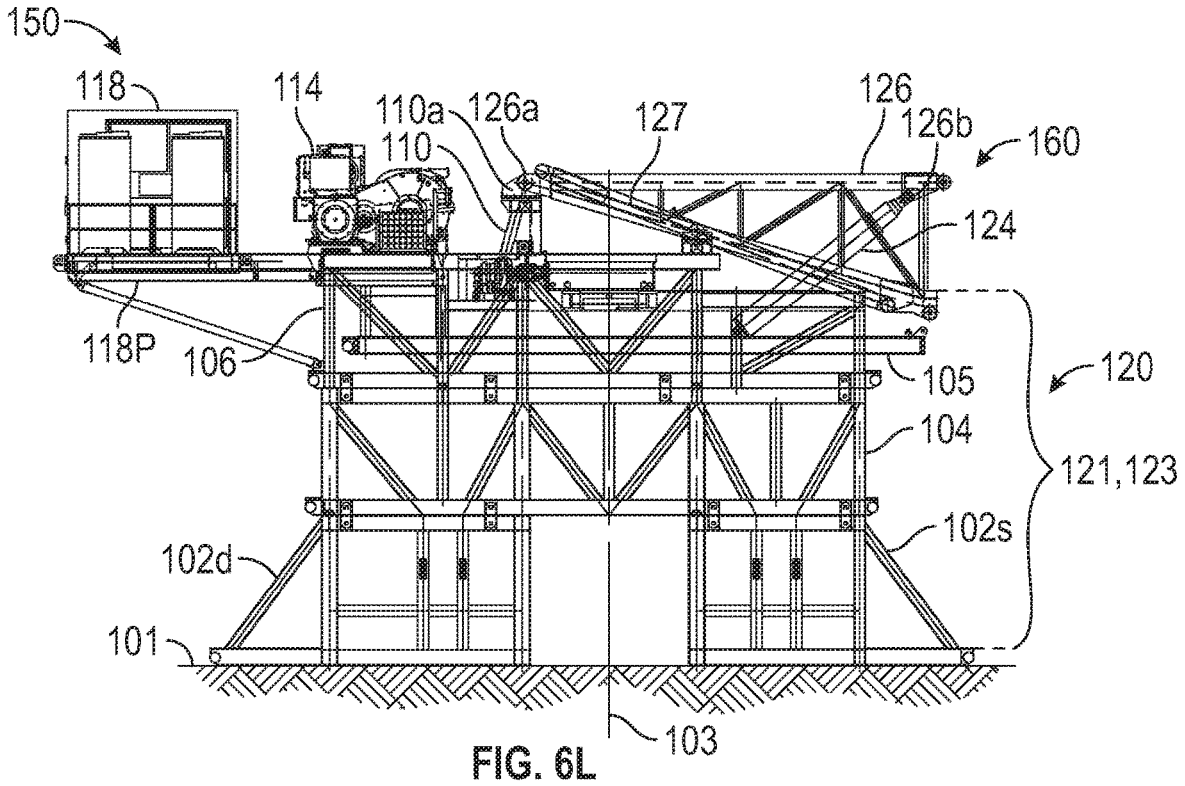
Figure 6M:
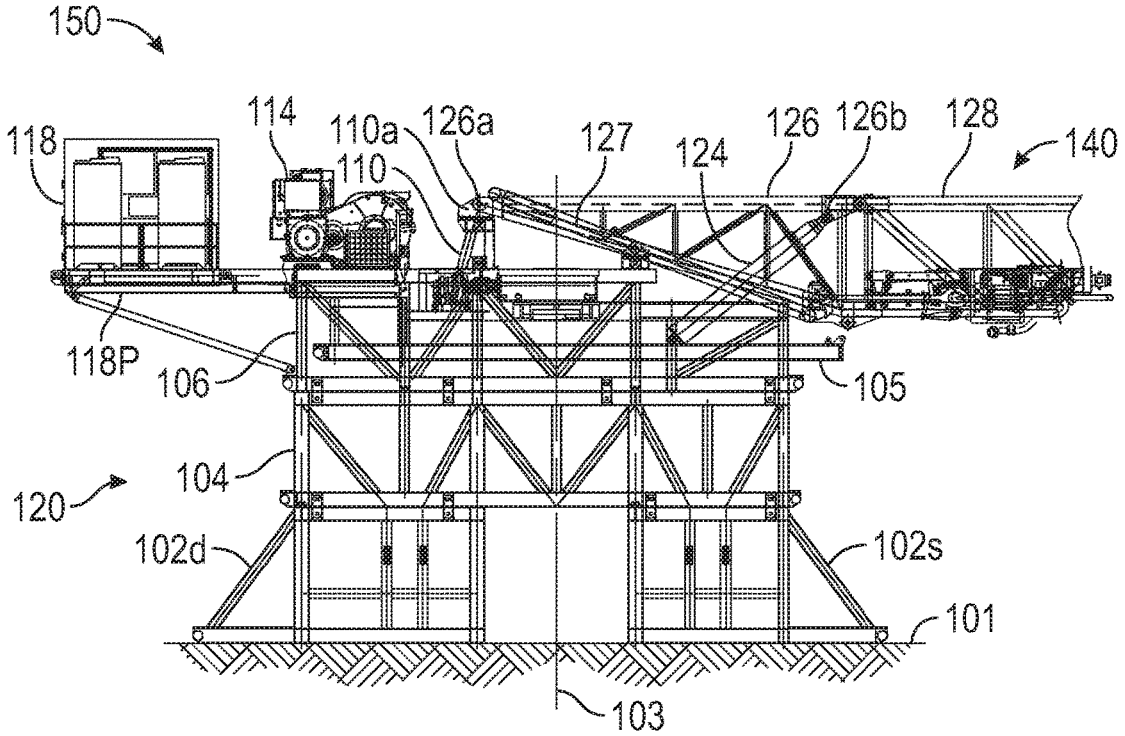
Figure 6N:
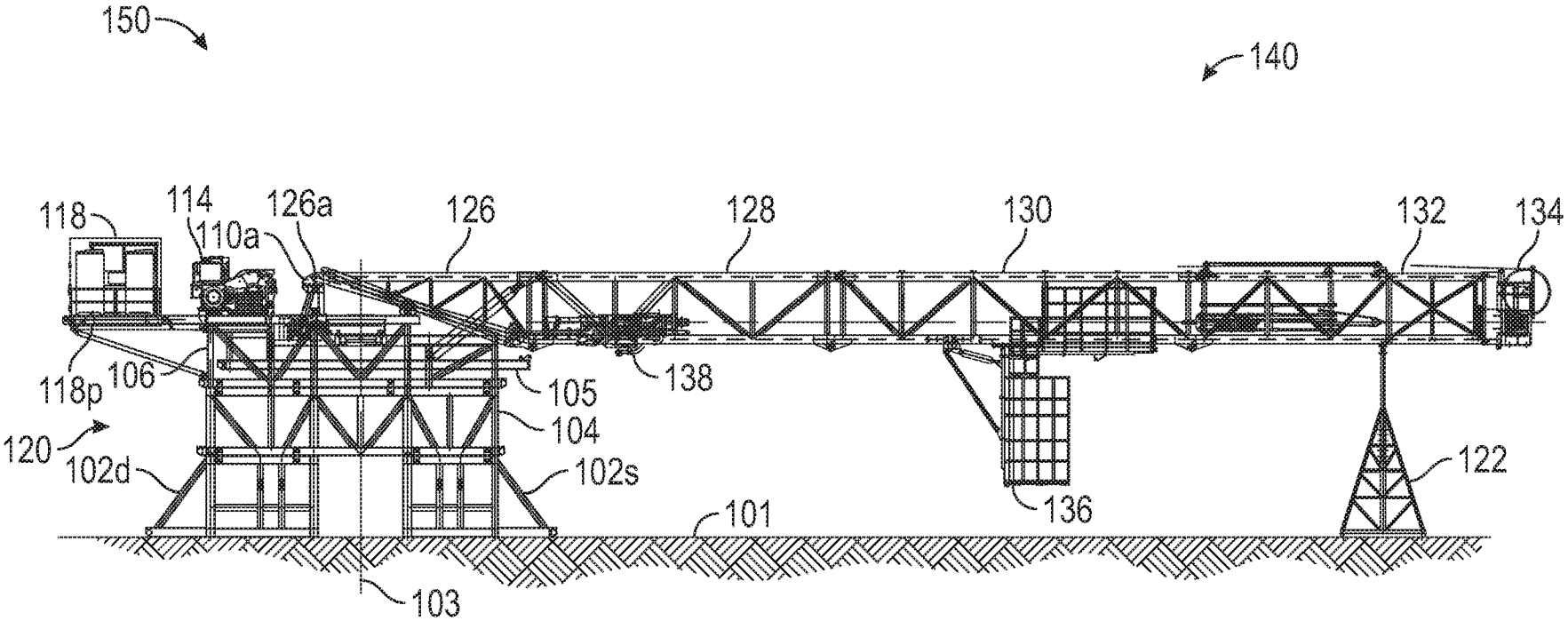
Figure 6Q:
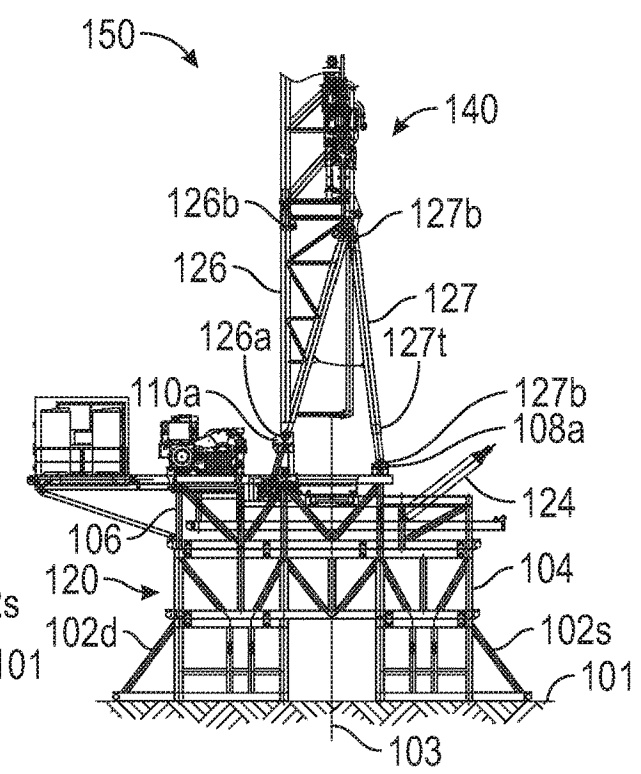
Figure 6P:
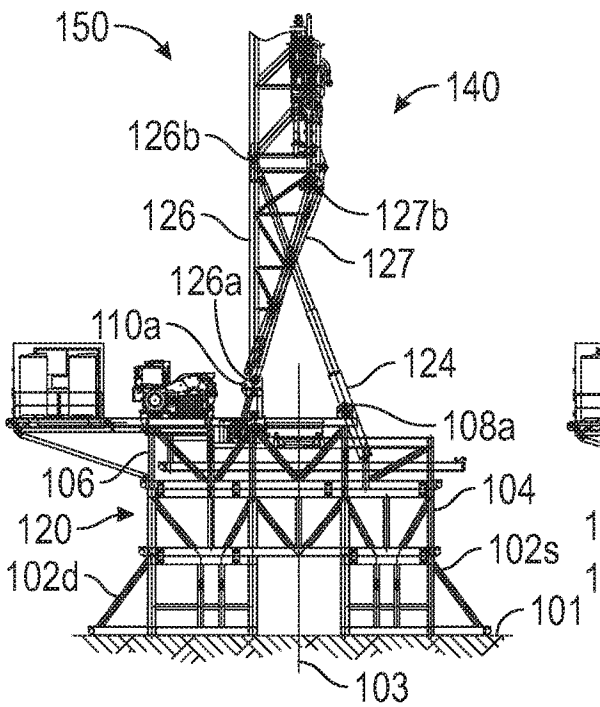
Figure 6O:
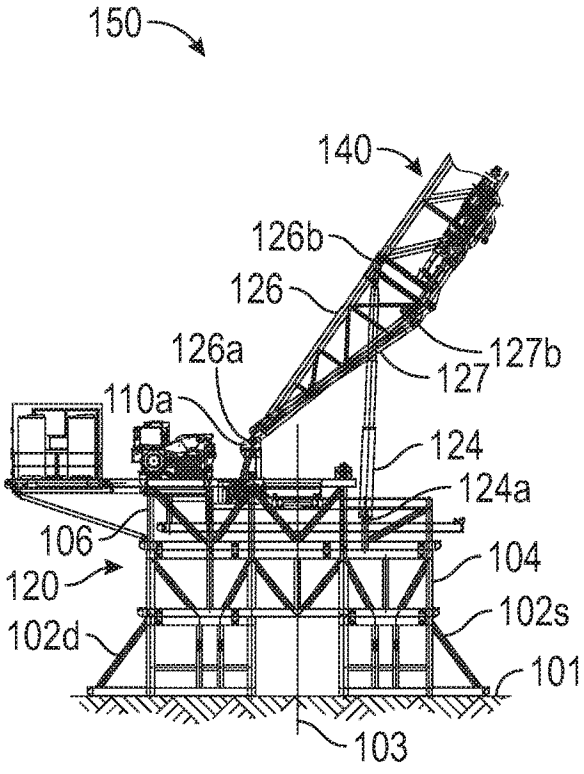
Figure 6R:
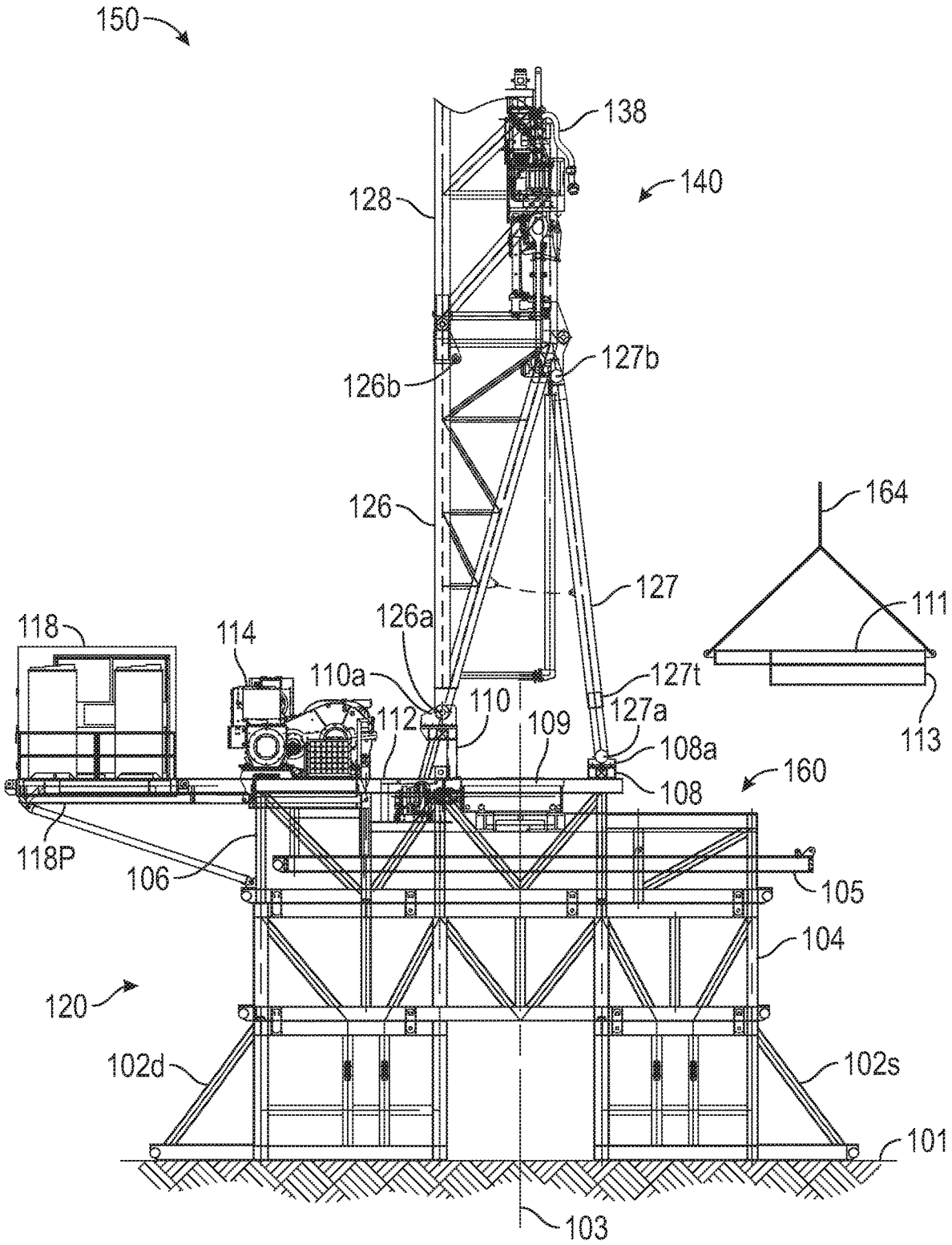
Figure 6S:
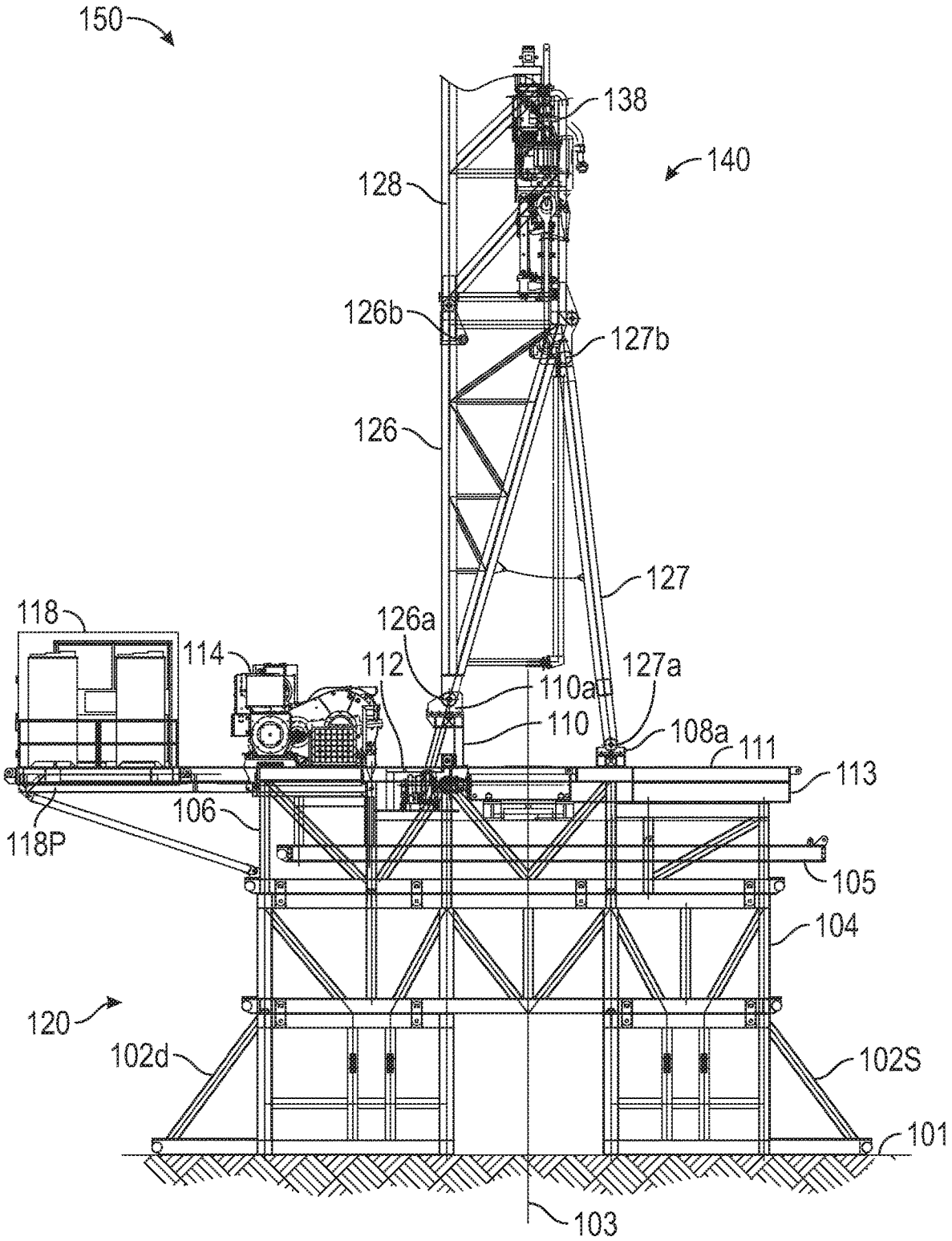
Figure 6T:
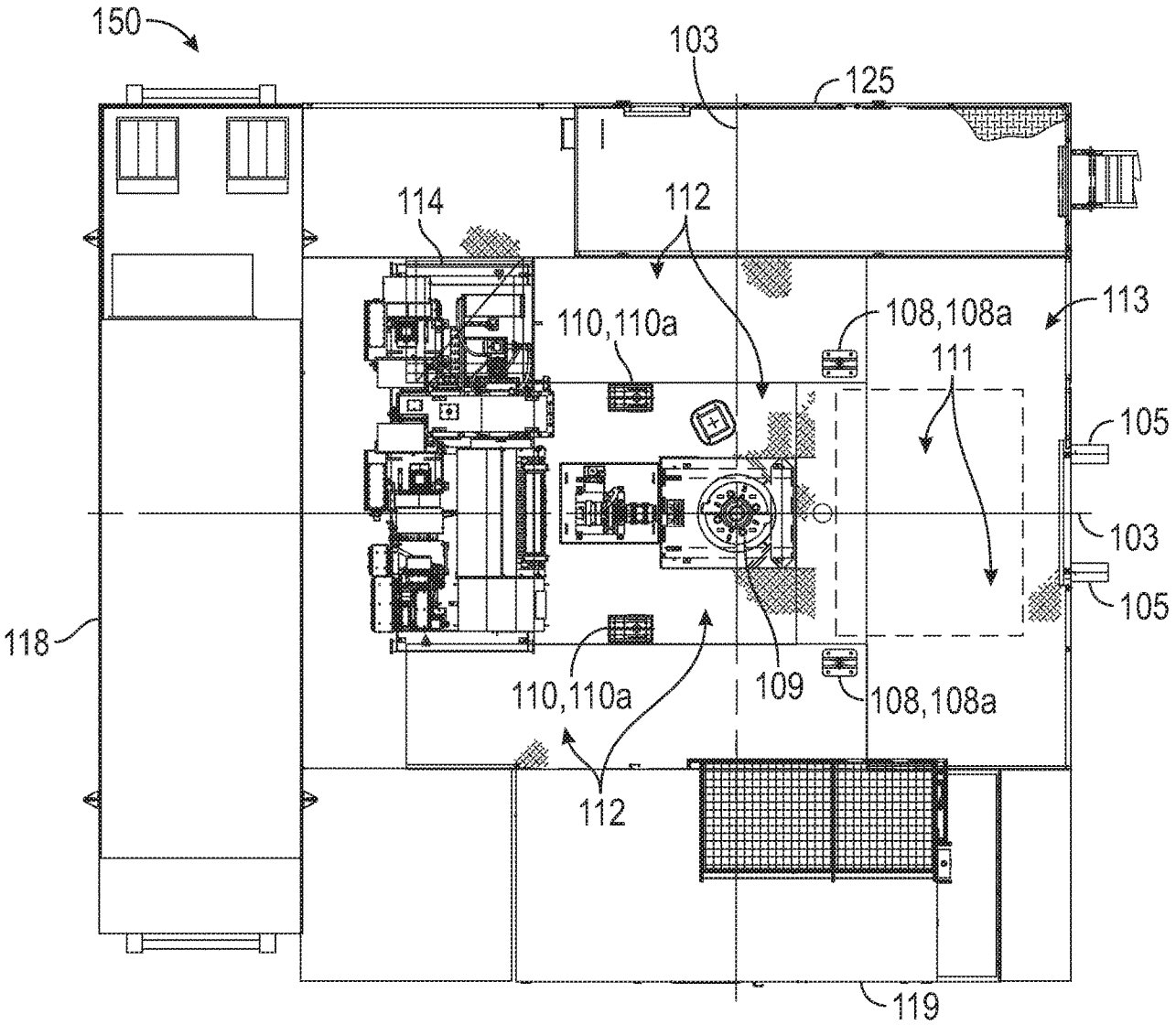

FIGS. 6A-6T illustrate various aspects of an exemplary method that may be used to assemble and erect the drilling rig structure 150 according to certain embodiments of the present disclosure, and will be described in detail below.

FIGS. 6A-6C are side elevation views and FIG. 6D is a plan view of the drilling rig structure 150 during the early stages of assembling the drilling rig substructure 120. As shown in FIG. 6A, two lower substructure boxes 102 (one shown only) may be positioned on the ground 101 (or on a drilling mat covering the ground 101) such that the two lower substructure boxes 102 are laterally spaced apart and straddle the vertical centerline of a wellbore 103 to be drilled using the drilling rig structure 150 (see, FIG. 6D). In the embodiment depicted in FIG. 6A, the lower substructure boxes may each include a drawworks side base box 102*d* and a setback side base box 102*s*, as is described with respect to FIGS. 2A and 2B above. Additionally, a front lateral positioning spacer 129*a* may be attached to and between the lower ends of the lower substructure boxes 102 proximate the setback side of substructure 120, such as between the two setback side base boxes 102*s*, and a rear lateral positioning spacer 129*b* may be attached to and between the lower ends of the lower substructure boxes 102 proximate the setback side of substructure 120, such as between the two drawworks side base boxes 102*d*, so as to maintain the proper spacing between and relative positions of the two lower substructure boxes 102.

Thereafter, a middle substructure box 104 is positioned on top of and removably attached to each of the base substructure boxes 102 (FIG. 6B), after which an upper substructure box 6 is positioned on top of and removably attached to each intermediate substructure box 104 (FIG. 6C). As indicated in FIGS. 6D-6F, these assembly steps thereby construct the driller's side stacked substructure box assembly 121 and the off-driller's side stacked substructure box assembly 123—i.e., in a "box-on-box" configurations—that are laterally spaced apart and straddle the wellbore centerline 103, thus forming the base structural framework of the substructure 120. So as not to obscure the drawings, it should be noted that only the upper substructure boxes 106 of each of the stacked substructure box assemblies 121, 123 are illustrated in the plan view of FIG. 6D, and the extended side braces 102*b* of the lower substructure boxes 102 have not been depicted.

As shown in FIGS. 6C and 6D, a front mast support shoe 108 (one shown in FIG. 6C) may be fixedly mounted on each of the upper substructure boxes 106. Furthermore, at this stage of assembling the substructure 102, the pinned structural connectors 108*a* (one shown in FIG. 6C) that are used to removably attach the pinned connections 127*a* at the lower ends of the two front mast support braces 127 to the upper substructure boxes 106 of the two stacked substructure box assemblies 121, 123 may be fixedly or removably attached to the front mast support shoes 108.

After the two stacked substructure box assemblies 121 and 123 have been completed, the center drill floor assembly 160 may then be positioned on and removably attached between the two upper substructure boxes 106, such that the center floor structure 107 of the center drill floor assembly 160 spans the lateral spacing distance between the two stacked substructure box assemblies 121 and 123, as is best illustrated in the plan view of the drilling rig structure 150 shown in FIG. 6G. For example, crane rigging 162 (schematically depicted in FIG. 6E) may be attached to the center drill floor assembly 160 and used to lift the assembly 160 into position above the substructure 120, as is shown in the elevation view of the drilling rig structure 150 depicted in FIG. 6E. Thereafter, the crane may be used to lower the center drill floor assembly 160 into the proper location between the two stacked substructure box assemblies 121, 123, after which the center floor structure 107 of the assembly 160 is removably attached to the two substructure box assemblies 121 and 123. FIGS. 6F and 6G are elevation and plan views, respectively, of the drilling rig structure 150 after installation of the center drill floor assembly 160 has been completed.

FIGS. 6H-6K are plan views showing several different steps during the assembly of the drilling rig structure 150. In particular, FIG. 6H shows the drilling rig structure 150 after the LER house support structure 118*p* has been removably attached to the drawworks side of the substructure 120 and to the center floor structure 107, and FIG. 6I shows the drawworks 114 after it has been installed above the center floor structure 107 and the upper substructure boxes 106. Additionally, FIG. 6J depicts the drilling rig structure 150 after the driller's cabin 119 and the ODS platform 125 have been removably attached to the respective driller's and off-driller's stacked substructure box assemblies 121 and 123, and FIG. 6K shows the LER house 118 after it has been installed above the support structure 118*p*. FIG. 6L is an elevation view of the drilling rig structure 150 after completion of the various assembly steps depicted in FIGS. 6H-6K, wherein the driller's cabin 119 and the ODS platform 125 are not shown for additional drawing clarity.

It should be appreciated by persons of ordinary skill that the particular installation sequence shown in FIGS. 6H-6K is exemplary only, as the depicted components may be installed using various other sequences, depending on the specific design of each component and any interrelated structural integrity and/or support requirements.

FIGS. 6M and 6N are elevations views of the drilling rig structure 150 during certain stages of assembling the drilling rig mast assembly 140. In particular, FIG. 6M shows an initial stage of assembling the drilling rig mast assembly 140 after the upper ends of the mast raising apparatuses 124 (one shown in FIG. 6M) have been pivotably coupled to the respective driller's and off-driller's side lower pinned connections 126*a* on the bottom mast section 126. FIG. 6M also shows the drilling rig structure 150 after the lower end of the first intermediate mast section 128 (only partially shown in FIG. 6M) has been removably attached to the upper end of the bottom mast section 126. In at least some embodiments, and depending on the type of connections used to removably attach the first intermediate mast section 128 to the bottom mast section 126, the mast raising apparatuses 124 may be actuated in order to facilitate the mast section attachment step by alternately raising and lowering the upper end of the bottom mast section 126 by a few degrees, e.g., 1°-5°, relative to its substantially horizontal initial orientation.

FIG. 6N shows the drilling rig structure 150 after the remaining mast sections—i.e., the second intermediate mast section 130 and the upper mast section 132—have been assembled, and after the crown block 134 has been mounted on the upper mast section 132, the racking board 136 has been mounted on the setback side of the drilling rig mast assembly 140, and the top drive assembly has been installed within the mast structure. Additionally, the fully assembled drilling rig mast assembly 140 is depicted in FIG. 6N as being substantially horizontally oriented and supported near its upper end by a mast stand 122 in preparation for being pivotably raised/erected to an operating orientation above the substructure 120. As noted above, and depending on the type of connections used between each individual mast section, the mast raising apparatuses 124 may be actuated so as to slightly raise and lower the partially completed mast as each subsequent mast section is attached to a preceding mast section.

FIGS. 6O-6Q are elevation views of the drilling rig structure 150 as the drilling rig mast assembly 40 is being pivotably raised/erected above the substructure 120 and fixed in place. As shown in FIG. 6O, drilling rig mast assembly 140 has been partially raised by actuation and extension of the mast raising apparatuses 124 (one shown in FIG. 6O), which causes the mast assembly 140 to pivot about the pivotable joints between the lower pinned connections 126*a* on bottom mast section 126 and the pinned structural connectors 110*a* on the respective rear mast support shoes 110. Additionally, FIG. 6P shows the drilling rig mast assembly 140 after the mast raising apparatuses 124 have been further actuated and extended until the drilling rig mast assembly 140 has been fully raised/erected to a substantially vertical operating orientation.

FIG. 6Q depicts a subsequent rig assembly step after the drilling rig mast assembly 140 has been fully raised/erected to the position illustrated in FIG. 6P. As shown in FIG. 6Q, the two front mast support braces 127 (one shown in FIG. 6Q) have been pivoted about the upper pinned connections 127*b*, the lengths of the mast support braces 127 have been adjusted and fixed using the telescoping structural connections 127*t*, and the lower pinned connection 127*b* on each of the mast support braces 127 has been removably attached to a pinned structural connection 108*a* of a respective front mast support shoe 108. Additionally, the upper ends of the two mast raising apparatuses 124 (one shown in FIG. 6Q) have been detached from the respective upper pinned connections 126*b* on the bottom mast section, thus transferring the full dead and environmental loads on the raised/erected drilling rig mast assembly 140 to the front and rear mast support shoes 108 and 110 through the rear legs of the bottom mast section 126 and the front mast support braces 127.

Due to the "nesting" arrangement of the bottom mast section 126 within the center drill floor assembly 160 (see, FIGS. 4A-4C), the bottom mast section 126 generally extends across a part of the setback side of the center floor structure 107 where the setback spreader section 113 will eventually be installed. As such, the setback spreader section 113 cannot be positioned on the setback side of the center floor structure 107 and attached to the upper substructure boxes 106 of the two stacked substructure box assemblies 121, 123 until after the drilling rig mast assembly 140 has been assembled and raised/erected above the substructure 120, since the presence of the "nested" bottom mast section 126 interferes with that installation.

FIG. 6R is an elevation view of the drilling rig substructure 150 depicted in FIGS. 6O-6Q after the drilling rig mast assembly 140 has been erected, wherein the mast assembly 140 is only partially illustrated so that additional detailed aspects of the disclosure are more readily apparent. As shown in FIG. 6R, crane rigging 164 (schematically depicted in FIG. 6R) may be attached to the setback spreader section 113 and used to lift the setback spreader section 113 into position above the substructure 120. Thereafter, the crane may be used to lower the setback spreader section 113 into the proper location above the setback ends of the center floor structure 107 and of the two stacked substructure box assemblies 121, 123, after which the setback spreader section 113 may be removably attached to the two substructure box assemblies 121 and 123 and to the center floor structure 107. Furthermore, since the setback spreader section 113 is a separately installed component of the drill floor, it can readily be modularized into configurations that are specifically adapted for certain drilling applications and/or drilling rig structure designs, as is previously described in conjunction with FIGS. 5A-5C above.

FIGS. 6S and 6T are elevation and plan views of the drilling rig structure 150 shown in FIG. 6R after the setback spreader section 113 has been mounted on substructure 120, wherein the drilling rig mast assembly 140 has been removed from the plan view of FIG. 6T so as not to unnecessarily obscure the drawings.

It should be noted that the drilling rig assembly steps depicted in FIGS. 6H-6T and described above generally teach an assembly sequence wherein the drilling rig mast assembly 140 is assembled (FIGS. 6M and 6N) and raised/erected (FIGS. 6O-6P) above the substructure 120 after the LER house support structure 118*p*, the drawworks 114, the driller's cabin 119, the ODS platform 125, and the LER house 118 have been mounted or installed on the substructure 120 (FIGS. 6H-6K), and wherein the setback spreader section 113 is mounted on the substructure 120 after the drilling rig mast assembly 140 has been raised/erected. However, it should be understood by those of ordinary skill after a complete reading of the present disclosure that in certain embodiments, the sequence of at least some of the rig assembly steps described above may be rearranged. In particular, and depending on the specific interdependent structural relationships between these components of the drilling rig structure 150, the drilling rig mast assembly 140 may be assembled and raised/erected above the substructure 120 and the setback spreader section 113 may be mounted on the substructure 120 before one, some, or all of the rig components described in conjunction with FIGS. 6H-6K have been mounted or installed.

For example, in certain embodiments, the support structure 118*p*, the drawworks 114, and LER house 118 may be mounted/installed on the substructure 120 prior to assembling and raising/erecting the drilling rig mast assembly 140, and the driller's cabin 119 and ODS platform 125 may then be mounted on the substructure 120 after the drilling rig mast assembly has been raised/erected and before or after the setback spreader section 113 has been mounted on the substructure 120. In other illustrative embodiments, one or both of the driller's cabin 119 and the ODS platform 125 may be mounted or installed on the substructure 120 before the drilling rig mast assembly 140 has been assembled and raised/erected, and the support structure 118*p*, the drawworks 114, the and LER house 118 may be mounted or installed before or after the setback spreader section 113 has been installed. In still further embodiments, some or all of the various drilling rig components described in conjunction with FIGS. 6H-6K—i.e., the drawworks 114, the LER house 118, the driller's cabin 119, and the ODS platform 125—may be mounted or installed on the substructure 120 simultaneously with the activities associated with assembling the drilling rig mast assembly 140 (see, FIGS. 6M and 6N), and the mast assembly 140 may thereafter be raised/erected and the setback spreader section 113 subsequently installed. It should therefore be appreciated that at least some of the particular assembly sequences disclosed herein can readily be modified without affecting the benefits afforded by the drilling rig components and assembly configurations described above.

Accordingly, the present disclosure provides various improved assemblies and arrangements for shipping the various components and systems of a drilling rig structure to a drilling site, including readily installable modular assemblies, and methods for assembling the drilling rig structure at the drilling site.

The particular embodiments disclosed above are illustrative only, as the subject matter defined by the appended claims may be modified and practiced in different but equivalent manners apparent to those skilled in the art having the benefit of the teachings herein. For example, some or all of the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

What is claimed is:

1. A center drill floor assembly of a drilling rig structure, the center drill floor assembly comprising:

a center floor structure;

a drilling rig mast section comprising:

a frame member having a first end positioned at a first vertical height lower than a second vertical height of an upper surface of the center floor structure when the center drill floor assembly is in a configuration for transportation and a second end distal from the first end, wherein the center drill floor assembly is adapted to be transported in the configuration for transportation to a drilling site as a single modular assembly and removably attached as said single modular assembly to a drilling rig substructure during assembly of the drilling rig structure, wherein the second end is pivotably coupled to the center floor structure; and a first mast support brace having a first end pivotably coupled to the first end of the frame member and a second end comprising a connector.

2. The center drill floor assembly of claim 1, further comprising a mast support shoe mounted on the center floor section, wherein the second end of the frame member opposite the first end is pivotably coupled to the mast support shoe.

3. The center drill floor assembly of claim 1, wherein an upper surface of the center floor structure is adapted to support a drill floor, and wherein the first vertical height of the first end is lower than a third vertical height of an upper surface of the drill floor in the configuration for transportation.

4. The center drill floor assembly of claim 3, further comprising a rotary drill table mounted on the center floor structure, wherein the first vertical height of the first end is lower than a fourth vertical height of an upper surface of the rotary drill table in the configuration for transportation.

5. The center drill floor assembly of claim 1, further comprising a mast raising apparatus that is pivotably coupled to the center floor structure.

6. The center drill floor assembly of claim 1, wherein the drilling rig mast section is a bottom drilling rig mast section that is adapted to be removably attached to at least one additional drilling rig mast section of a drilling rig mast assembly.

7. The center drill floor assembly of claim 1, further comprising a second mast support brace having a first end pivotably coupled to the first end of the drilling rig mast section and a second end comprising a connector.

8. The center drill floor assembly of claim 1, wherein the mast support brace comprises a telescoping structural connection.

9. A drilling rig structure, comprising:

a substructure that comprises two spaced-apart substructure box assemblies;

a center drill floor assembly comprising a center floor structure, a mast support shoe mounted on the center floor structure, and a bottom drilling rig mast section having a frame member including a first end that is pivotably coupled to the mast support shoe, a first mast support brace having a first end pivotably coupled to a second end of the frame member opposite the first end of the frame member and a second end comprising a connector, wherein the center drill floor assembly is adapted to be transported to a drilling site in a configuration for transportation as a single modular assembly and removably attached as said single modular assembly to the two spaced-apart substructure box assemblies during assembly of the drilling rig structure.

10. The drilling rig structure of claim 9, further comprising a drill floor positioned on an upper surface of the center floor structure, wherein the first end of the frame member is positioned at a first vertical height lower than a second vertical height of an upper surface of the center floor structure and a third vertical height of the drill floor when the center drill floor assembly is in the configuration for transportation during transportation of the center drill floor assembly to the drilling site.

11. The drilling rig structure of claim 10, wherein the center drill floor assembly further comprises a rotary drill table mounted on the center floor structure, wherein the first vertical height of the first end is lower than a fourth vertical height of an upper surface of the rotary drill table in the configuration for transportation.

12. The drilling rig structure of claim 9, further comprising at least one additional drilling rig mast section that is adapted to be removably attached to the bottom drilling rig mast section after the center drill floor assembly has been removably attached to the two spaced-apart substructure box assemblies so as to form a drilling rig mast assembly.

13. The drilling rig structure of claim 12, further comprising a setback spreader section that is adapted to be removably attached to the two spaced-apart substructure box assemblies after the drilling rig mast assembly has been raised to an operating orientation above the substructure.

14. The drilling rig structure of claim 13, wherein the setback spreader section is adapted to be transported to a drilling site as a single modular section and removably attached as said single modular section to the two spaced-apart substructure box assemblies during assembly of the drilling rig structure.

15. The drilling rig structure of claim 9, wherein each of the two spaced-apart substructure box assemblies is a stacked substructure box assembly having a box-on-box configuration.

16. The drilling rig structure of claim 9, wherein the mast support brace comprises a telescoping structural connection.

17. A method of assembling a drilling rig structure, the method comprising:

assembling a center drill floor assembly comprising a center floor structure, a bottom drilling rig mast section comprising a frame member having a first end positioned at a first vertical height lower than a second vertical height of an upper surface of the center floor structure when the center drill floor assembly is in a configuration for transportation and a second end distal from the first end, wherein the second end is pivotably coupled to the center floor structure, and a first mast support brace having a first end pivotably coupled to the first end of the frame member and a second end comprising a connector;

transporting the assembled center drill floor assembly to a drilling site as a single modular assembly in the configuration for transportation;

positioning first and second substructure box assemblies of a drilling rig substructure adjacent to a wellbore location at the drilling site, wherein the first and second substructure box assemblies are spaced apart and straddling the wellbore location;

removably attaching the center drill floor assembly as said single modular assembly to the first and second spaced-apart substructure box assemblies;

after removably attaching the center drill floor assembly to the first and second spaced-apart substructure box assemblies, removably attaching at least one additional drilling rig mast section to the bottom drilling rig mast section so as to assemble a drilling rig mast assembly;

raising the assembled drilling rig mast assembly to an operating orientation above the drilling rig substructure; and attaching the connector of the mast support brace to one of the first and second spaced-apart substructure box assemblies.

18. The method of claim 17, wherein assembling the center drill floor assembly comprises pivotably coupling the second end of the frame member opposite the first end to a mast support shoe mounted on the center floor structure.

19. The method of claim 17, wherein positioning each of the first and second spaced-apart substructure box assemblies adjacent to the wellbore location comprises:

positioning a lower substructure box adjacent to the wellbore location;

removably attaching a middle substructure box to an upper end of the lower substructure box; and removably attaching an upper substructure box to an upper end of the middle substructure box.

20. The method of claim 19, wherein positioning the lower substructure box adjacent to the wellbore location comprises positioning first and second spaced-apart base boxes adjacent to the wellbore location, and wherein removably attaching the middle substructure box to the upper end of the lower substructure box comprises removably attaching the middle substructure box to upper ends of the first and second spaced-apart base boxes.

21. The method of claim 20, further comprising, after raising the assembled drilling rig mast assembly above the drilling rig substructure, removably attaching a setback spreader section to the first and second substructure box assemblies, wherein the setback spreader section is positioned above part of the center floor structure.

22. The method of claim 17, further comprising removably mounting at least one of a drawworks, a local equipment house, a driller's cabin, and an off-driller's side platform on the drilling rig substructure prior to raising the assembled drilling rig mast assembly.

23. The method of claim 17, wherein the mast support brace comprises a telescoping structural connection.

* * * * *